US009248681B2

(12) United States Patent
Anthony et al.

(10) Patent No.: US 9,248,681 B2
(45) Date of Patent: Feb. 2, 2016

(54) SELF-INKING MARKING DEVICE HAVING INK ROLLER ON SWINGARM ASSEMBLY AND PIVOTABLE DIE PLATE

(71) Applicant: Navitor, Inc., North Mankato, MN (US)

(72) Inventors: John Anthony, Downers Grove, IL (US); Rich Williams, Aurora, IL (US); James Orrico, Chicago, IL (US)

(73) Assignee: Navitor, Inc., North Mankato, MN (US)

( * ) Notice: Subject to any disclaimer, the term of this patent is extended or adjusted under 35 U.S.C. 154(b) by 107 days.

(21) Appl. No.: 13/750,370

(22) Filed: Jan. 25, 2013

(65) Prior Publication Data

US 2013/0291744 A1 Nov. 7, 2013

Related U.S. Application Data

(60) Provisional application No. 61/590,415, filed on Jan. 25, 2012, provisional application No. 61/715,652, filed on Oct. 18, 2012.

(51) Int. Cl.

| | |
|---|---|
| ***B41K 1/10*** | (2006.01) |
| ***B41K 1/42*** | (2006.01) |
| ***B41K 1/12*** | (2006.01) |

(52) U.S. Cl.

CPC ... *B41K 1/10* (2013.01); *B41K 1/12* (2013.01); *B41K 1/42* (2013.01)

(58) Field of Classification Search

CPC ..... B41K 1/10; B41K 1/12; B41K 1/16; B41K 1/40; B41K 1/42

USPC ..... 101/93.13, 103, 104, 105, 106, 109, 101/111, 327, 333, 334, 405, 406

See application file for complete search history.

(56) References Cited

U.S. PATENT DOCUMENTS

| | | | | |
|---|---|---|---|---|
| 620,922 | A | 3/1899 | Hill | |
| 669,137 | A | 3/1901 | Dobbel | |
| 770,956 | A * | 9/1904 | Bradley | 101/106 |
| 1,039,792 | A | 10/1912 | Payne | |
| 1,291,057 | A * | 1/1919 | Marks | 101/103 |
| 1,330,251 | A | 2/1920 | Folger et al. | |

(Continued)

FOREIGN PATENT DOCUMENTS

| | | |
|---|---|---|
| EP | 126 0 378 | 12/2008 |
| EP | 160 9 608 | 2/2010 |

(Continued)

OTHER PUBLICATIONS

PCT Invitation to Pay Additional Fees and, Where Applicable, Protest Fee, for PCT Application No. PCT/US2013/023175, dated May 7, 2013.

(Continued)

*Primary Examiner* — Leslie J Evanisko

(74) *Attorney, Agent, or Firm* — Patterson Thuente Pedersen, P.A.

(57) ABSTRACT

A self-inking marking device having adjustable print bands configured to be adjustable by a single adjustment knob, with a readily viewable display for viewing the current status of the print interface. In an embodiment, a self-inking marking device generally includes a display interface, an upper body, a lower body, adjustment components, and printing components. The printing components include components to affect a unique self-inking method that utilizes an ink roller that inks the die while rolling along the surface of the die plate.

16 Claims, 17 Drawing Sheets

(56) References Cited

U.S. PATENT DOCUMENTS

| | | | | | |
|---|---|---|---|---|---|
| 2,054,127 | A | | 9/1936 | Johnson et al. | |
| 3,380,378 | A | | 4/1968 | Edwards et al. | |
| 3,504,622 | A | | 4/1970 | Morrison | |
| 3,625,143 | A | | 12/1971 | Nettesheim et al. | |
| 4,013,007 | A | | 3/1977 | Flynn | |
| 4,149,459 | A | | 4/1979 | Flynn et al. | |
| 4,291,622 | A | | 9/1981 | Bengtsson | |
| 4,478,146 | A | * | 10/1984 | Mistyurik | 101/205 |
| 4,679,500 | A | * | 7/1987 | Volk | 101/111 |
| 4,706,564 | A | | 11/1987 | Skopek | |
| 4,858,526 | A | | 8/1989 | Bengtsson | |
| 5,359,932 | A | | 11/1994 | Van Breene | |
| D353,394 | S | | 12/1994 | Stefanski et al. | |
| 5,740,737 | A | | 4/1998 | Polak et al. | |
| 5,942,312 | A | | 8/1999 | Venkataraman et al. | |
| 5,972,566 | A | | 10/1999 | Venkataraman | |
| 5,983,789 | A | * | 11/1999 | Fogle | 101/111 |
| 5,992,312 | A | | 11/1999 | Faber | |
| 6,163,329 | A | | 12/2000 | Venkataraman et al. | |
| 6,180,036 | B1 | | 1/2001 | Venkataraman et al. | |
| 6,229,556 | B1 | | 5/2001 | Venkataraman | |
| 6,991,332 | B1 | | 1/2006 | Fan et al. | |
| 7,654,198 | B2 | | 2/2010 | Faber | |
| 2003/0047091 | A1 | | 3/2003 | Kashiwaba | |
| 2007/0169644 | A1 | | 7/2007 | Suda | |

FOREIGN PATENT DOCUMENTS

| | | |
|---|---|---|
| GB | 193283 | 2/1923 |
| GB | 398754 | 9/1933 |

OTHER PUBLICATIONS

PCT Notification of Transmittal of the International Search Report, for PCT Application No. PCT/US2013/023175, dated Jul. 30, 2013. International Preliminary Report on Patentability dated Jul. 29, 2014 for PCT Application No. PCT/US2013/023175 filed Jan. 25, 2013, 11 pages.

* cited by examiner

100

FAXED
NOV/28/2011
118
108
102
128
112
116
114
104
106

Fig. 9A
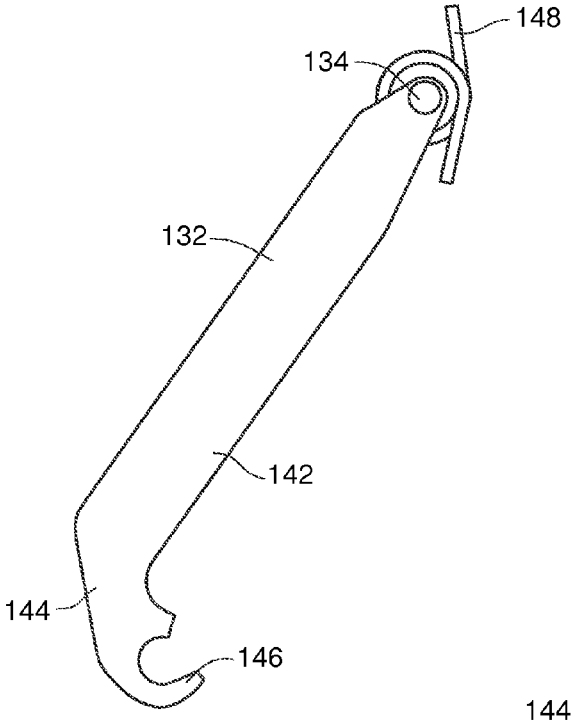
Fig. 9B
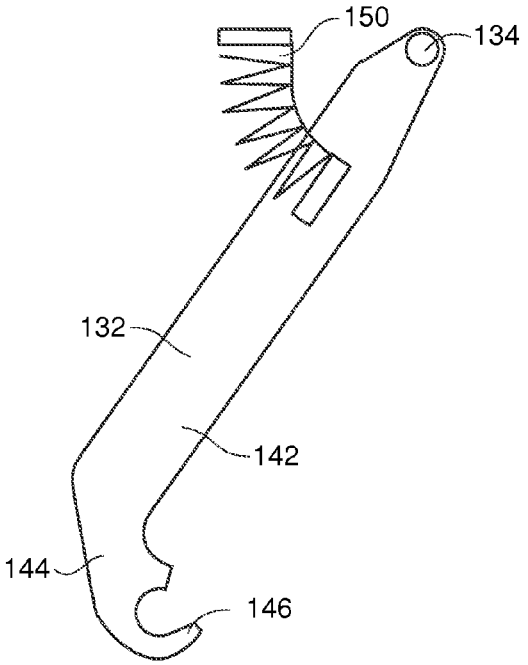
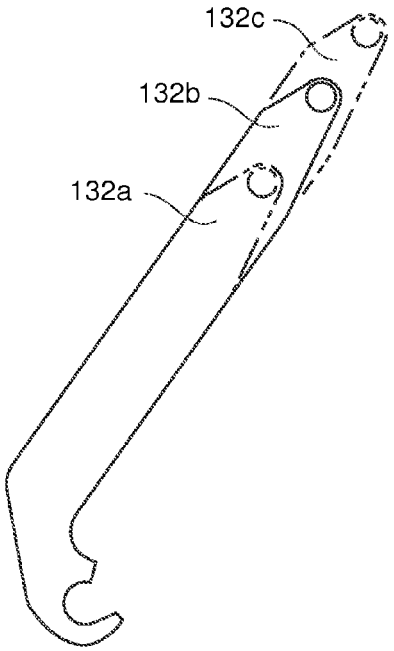
Fig. 10

SELF-INKING MARKING DEVICE HAVING INK ROLLER ON SWINGARM ASSEMBLY AND PIVOTABLE DIE PLATE

RELATED APPLICATION

The present application claims the benefit of U.S. Provisional Application No. 61/590,415, filed Jan. 25, 2012, and also claims benefit to U.S. Provisional Application No. 61/715,652, filed Oct. 18, 2012, both which are incorporated herein in their entirety by reference.

TECHNICAL FIELD

The invention relates generally to marking devices, including, for example, hand stamps, and more particularly, to self-inking marking devices with adjustable print bands.

BACKGROUND

Marking devices that imprint information from a die onto a sheet of paper or other receiving surface have been used in the art for some time. Marking devices of the prior art, for example, traditional hand stamps, originally required a user to depress the die into an ink source, where ink would be deposited onto the die, and subsequently required the user to depress the inked die onto the receiving surface. More recently, self-inking stamps utilizing a spring force and an internally-incorporated ink source have been devised. However, marking devices of the prior art suffer from a myriad of problems, especially in the context of marking devices incorporating adjustable daters or other adjustable print heads.

Marking devices incorporating adjustable print heads are most commonly used to imprint the date or other timestamp-type data. Daters of the prior art thus typically utilize bands or loops of numbers having an ink-receivable surface that is configured to be rotatable or pivotable along the print interface in order to change the value of the stamped data, wherein the print interface is the area of the die or other imprinting structure designed to contact ink and subsequently, the receiving surface in order to create an imprint or stamp on the receiving surface. For example, a first band containing the number values of 0 through 9 in combination with a second band containing the number values 0 through 9 can be configured to represent a two-digit number and therefore, can represent the days in a month. Month names and/or years can also be incorporated adjacent the numerical day value using a similar combination of print bands. Other bands are also often utilized in combination with date bands. For example, in the package delivery or shipping context, a band having the statuses of "Received," "Shipped," "In Process," and "Pending," etc. are also available and can be rotated between in order to give context to a date being stamped. Similarly, in the accounting context, statuses such as "Faxed," "Received," and "Paid," etc. are likewise available. In order to adjust the print bands in daters of the prior art, a user is often required to manually rotate tiny wheels that in turn affect rotation on the date bands. This is often difficult and tedious, as the wheels are generally smaller than is comfortable to the interface of the average human finger. These wheels can often be located within a recessed housing, thus increasing the difficulty of adjustment. Additionally, a separate wheel is often linked to every adjustable band. As a result, rotation of separate wheels is typically required in order to adjust every changeable field. These wheels are often placed close together, further complicating the band adjustment process.

The user experience in daters of the prior art is further worsened by the lack of visibility into what is currently set at the print interface. As an initial matter, the adjustment wheels described above are often unlabeled. As a result, the user is often required to resort to trial and error or a recursive process of adjusting a wheel and examining the print interface in order to see which bands are being adjusted to what setting. Typically, this requires the user to invert the dater, adjust a wheel or series of wheels, while examining the print interface, which is backwards as read by the user to determine which value has been adjusted or needs further adjustment. Alternatively, this could require the user to make an impression of the current setting to ensure the correct setting has been established.

Further, on self-inking daters, a die plate is typically pivoted from a retracted, hidden from the user, inking position within the body of the dater to a forward, printing position at a distal position from the ink source. As a result, in order to see the print interface, the user must invert the dater, cause the die plate to rotate from the ink source (often by pressing the handle with one hand and stabilizing the body with the other or by pressing the handle against a flat surface), and then view the actual raised characters that are in the printing position. Additionally, the user often attempts to adjust the print bands while the dater is under this springing force, which requires two hands and specific pressure on the dater, while achieving the necessary hand-eye coordination to achieve the required results or setting. Clearly, the above described processes of inverting the dater in order to view the print interface and/or partially or fully projecting the die plate from the ink source on self-inking daters of the prior art, often while trying to adjust the print bands, combined with the forced backwards reading of the print interface are wildly inefficient.

Alternatively, a locking feature is occasionally incorporated into daters of the prior art. With such locking features, the dater can be depressed and subsequently locked with the print interface in the inverted position, thereby allowing the user to temporarily relieve the constant springing force required of the user to project the print interface. However, activating this locking feature necessarily requires an extra step when adjusting the print interface. In addition, because the user must closely examine or inspect the print interface on traditional daters in order to learn of the current position of the print bands, the risk of the user inadvertently getting ink on his fingers, clothes, or other surrounding materials is greatly increased. This problem is exacerbated in self-inking daters of the prior art where the user must press on the handle with one hand and stabilize the body with the other hand in order to rotate the die plate from the ink source (and near the user's stabilizing hand at the printing end), or activate a locking feature that keeps the die plate in the projected position. This problem is further exacerbated in daters of the prior art where adjustment wheels are located within a recessed body near the ink source.

An additional category of marking devices having adjustable print interfaces are so-called numberers. In numberers, adjustable print bands are used to apply identification numbers or numeric codes, often for product identification or packaging purposes. Numberers of the prior art typically suffer from the same problems as described above with respect to daters.

Therefore, there is a need for a self-inking marking device having adjustable print bands that allows for the efficient adjustment of print band settings and further easily allows the user to view the current print band settings.

SUMMARY OF THE INVENTION

Embodiments of the present application substantially meet the aforementioned needs of the industry. Embodiments provide a self-inking marking device having adjustable print bands that are configured to be adjustable by a single adjustment knob, with a readily viewable display for viewing the current status of the print interface, wherein the print interface is the area of the die or print band designed to contact ink and subsequently, the receiving surface in order to create an imprint or stamp on the receiving surface. The terms "marking" and "printing" are used interchangeably throughout this specification.

In an embodiment, the self-inking marking device comprises print bands that correspond to a month, day, and year, respectively. In other embodiments, other status bands are also incorporated, such as "Received," "Shipped," "In Process," "Pending," "Faxed," and "Paid," etc. In still other embodiments, print bands can be adjusted to spell out these statuses. In embodiments, an individual print band can have a plurality of printing options; for example, up to 14. Other embodiments having additional or fewer printing options are also considered, and can depend on the particular marking device application, in embodiments. In embodiments, the number of print bands is based on the choice of a particular user or manufacturer as to the size and intended use of the product, thus creating a limitless number of print band quantities and configurations.

In another embodiment, print bands can comprise individual faces having static graphics, text or alphanumeric characters, punctuation, logos, protrusions, seals, symbols, patterns, or combinations thereof. Further, embodiments can comprise "spaces" where no letter or symbol is present at a particular location of a print band. Instead, a flat area is positioned such that no impression is left on the receiving surface, resulting in a gap or spacing on the receiving surface due to the flat area never contacting the ink source during inking, thus depicting a space on the receiving surface.

In another embodiment, a traditional non-self inking marking device is provided. In embodiments, the self-inking mechanisms of this marking device are absent or, alternatively, are present but configured inactive, and thus allow a user to depress the print interface into a separate ink source, where ink is deposited onto the print interface, and subsequently allows the user to depress the inked print interface onto the receiving surface.

In another embodiment, a numberer device is provided. In embodiments, the print bands of this marking device are configured to have indicia that can represent identification numbers or numeric codes for product identification or packaging purposes. In embodiments, multiple print bands are provided in order to imprint multiple pieces of numbered data. In another embodiment, a so-called "heavy duty" marking device is provided. In embodiments, this marking device optionally comprises a handle that extends upwards from a top surface of the marking device. The handle is configured to be operably coupleable with the hand of the user. Optionally, in embodiments, all or portions of the body are open. For example, front and back walls are removed from marking devices having four sidewalls such that only the two remaining sidewalls provide the body of the heavy duty marking device. By removing the front and back wall material, cost and weight savings can be recognized. In embodiments, the two remaining sidewalls can be reinforced with steel.

The terms "marking device," "dater," and "stamp" are used herein interchangeably, with the understanding that all reflect devices that can have adjustable printing values. Further, for ease of discussion, embodiments are generally discussed herein with respect to adjustable date values. However, the invention is in no way limited to dates; on the contrary, embodiments described herein may be applied to any marking device where an adjustable print interface is desirable. In a feature and advantage of embodiments of the invention, a self-inking marking device comprises display interface viewable from a top surface or a side surface of the marking device that readily displays the current status of the print interface clearly and accurately. As a result, trial and error wheel adjustment or iterative process of wheel adjustment and readjustment is minimized or eliminated. The user is likewise not forced to read the print interface upside down in order to discern the adjusted values. Referring to the problem of self-inking daters of the prior art, inversion of the dater and partially or fully projecting the die plate(s) from the ink source in order to view the actual raised characters that are in the printing position is unnecessary. Further, because the ink-receiving print interface can remain on the work surface or within the body of the device, in embodiments, the risk of the user inadvertently getting ink on his fingers, clothes, or other surrounding materials is minimized or eliminated as a result of the process of setting the values to be stamped. Further, referring to daters of the prior art where adjustment wheels are located within a recessed body near the ink source, placement of the user's fingers in close proximity to the ink source is unnecessary. In embodiments, the display viewable from the top or side of the device is angled toward the user for easy viewing. The user may remain comfortably seated without straining to see on the set values that will be impressed onto the receiving surface. In another embodiment, the current setting or status of the print interface is displayed at a location on a side of the marking device body. For example, if a particular marking device has a lengthy imprint and therefore an elongated body, it may be more convenient to have the display on a side of the body rather than the top. Additionally, in embodiments, the marking device can have changeable display cards for placement within the display interface and proximate the current status of the print interface that correspond to the various dies that may supplement the adjustable print values so that a fully accurate depiction of the print interface can be provided. For example, a display card displaying "FAXED" can be inserted in the display interface when the corresponding "FAXED" die is being used at the print interface.

In another feature and advantage of embodiments of the invention, a single adjustment knob projecting from the body of the marking device allows the user to not only easily adjust individual print bands, but to also move between print bands. In embodiments, the adjustment knob has enough bulk to provide a readily graspable interface for the user. In operation, the adjustment knob can be positioned between the user's thumb and forefinger or thumb and middle finger for easy rotation or transverse adjustment. The adjustment knob can have raised gripping projections that provide additional enhanced interfaces for the user when rotation or transverse adjustment is desired, in embodiments. In operation, in an embodiment, the adjustment knob can be moved transverse to the marking device body, and likewise transverse to the print bands, which are positioned in a loop parallel to the length of the marking device body, to select the desired print band for adjustment. When the desired print band is selected, the adjustment knob can then be rotated, which in turn causes that particular print band to be rotated. The print band is rotated in this way until the desired setting is obtained. The adjustment knob can then be again moved transverse to the marking device body and print bands to select another print band for adjustment. Likewise, the adjustment knob can then again be rotated, which in turn causes the newly-chosen print band to be rotated. Therefore, no manual rotation of numerous individual tiny adjustment wheels is required in order to adjust the print interface.

In another feature and advantage of embodiments of the invention, the marking device can comprise a plurality of adjustable lines of print and therefore, a plurality of adjustment knobs. For example, in an embodiment, a marking device includes a first line of adjustable print that corresponds to a first set of print bands having indicia representing a numeric code or phrase, and further includes a second line of adjustable print corresponding to a second set of print bands, such as a date. In this embodiment, a first adjustment knob corresponds to the first set of print bands and a second adjustment knob corresponds to the second set of print bands. Therefore, a first code or phrase can be adjusted by the first adjustment knob interface to the first set of print bands and a secondary date can be adjusted by the second adjustment knob interface to the second set of print bands. In embodiments, additional lines of print and print band sets and corresponding adjustment knobs are provided. In another feature and advantage of embodiments of the invention, as the adjustment knob moves from print band to print band, a tactile indication and/or visual indication of the selected band displayed in the display interface aids the user in identifying the currently-selected band. In an embodiment, the interface between the bands as traveled by the adjustment knob has variated haptic detents for signaling the particular bands. A series of detents to mechanically arrest the motion of the adjustment knob signal to the user, based on the particular arresting force of the particular detent of a particular band, on what band the adjustment knob is currently selected. In an embodiment, a series of detents span from most arresting to least arresting, thus reflecting months, days, then years to the user when adjusting between the bands. In another embodiment, detents require the most force to adjust from days, the easiest force to adjust to years, and an intermediate force to adjust to months. In another embodiment, detents require the most force to adjust to days, and intermediate equivalent forces to adjust to months and years. Typically, it is desirable to have detents require the most force to move from days because it is the most frequently adjusted value. The user is able to feel the variated detents and associated variated arresting force through the adjustment knob interface. In another embodiment, the display interface shows the position of the adjustment knob through highlighting of the adjustable values on the display interface. In an embodiment, a mechanical ring encircles the currently-selected band. In another embodiment, the currently-selected band is slightly elevated from the non-selected bands. Various other appropriate visual indicators are also considered. The above-described tactile or visual indications of the band position of the adjustment knob can be used in combination or alone, in embodiments.

In another feature and advantage of embodiments of the invention, a display card storage area is provided within the body of the marking device. As described above, where changeable display cards that correspond to the various dies are utilized to accurately depict the print interface, the non-used cards can be stored in a single location within the marking device itself in the display card storage area until they are used (when the corresponding die is used). As a result, no display cards are in danger of being lost, and there is no need for the user to try and find cards associated with the marking device somewhere else in the office, as the non-used cards are kept inside the marking device.

Therefore, because of the top display that readily displays the current status of the print interface, the single adjustment knob with associated variated haptic detents between print bands and/or visual indication of the selected band, and the display card storage, the user interface is greatly improved over daters of the prior art.

In an embodiment, a single print band comprises a "print side" that is configured to be inked and to subsequently print on the receiving surface, as well as a corresponding opposite "read side" that is configured to display the opposing print side value. Therefore, each print band has a print side and a read side connected in the band loop. Problems arise in adjustable band devices when the print side values are over-rotated into the display area, or likewise when read side values are over-rotated into the print area. Ink residue from previous inkings can damage or even destroy the display interface, often making the display unreadable. Therefore, it is desirable to have the read side values remain free of ink and positioned only at the display interface, and likewise for the print side values to remain out of the display interface. In another feature and advantage of embodiments of the invention, a hard stop is created within each band at the read-side-print-side interface point(s). The hard stop inhibits rotation of the band such that there is no possibility of over-rotating the read side into the print side or the print side into the read side. As a result, the display interface is preserved and kept ink-free.

In embodiments, the read side of a print band has contrasting colors for the values and background; for example black characters on a white background. In embodiments, the read side characters can be grouped together in a block opposite the print side characters, as described above. In another embodiment, read side characters and print side characters are mixed throughout the band, thus alternating along the loop. Myriad other configurations of print side characters and read side characters are considered.

Because of the aforementioned embodiment having print bands with a "read side" portion of the band opposite a "print side" portion of the band, the overall height of the dater can become quite tall with self-inking methods of the prior art. A dater having excessive height is often unwieldy and unstable as it is easily knocked over when in a neutral upright position, and further becomes difficult for the user to operate. Embodiments therefore provide a unique self-inking method that utilizes an ink roller that inks the die while rolling along the surface of the die plate. In embodiments, the ink roller is more compact than the ink pad of self-inking daters of the prior art. In alternative embodiments, a similarly compact ink pad can be utilized instead of an ink roller. Thus, storage advantages are realized as the ink source requires little volume within the body of the marking device. As a result, the overall height of the marking device is kept at a height that is practical and efficient, as well as user-friendly.

In another issue with lengthy print bands, the rotational path with a rotational band is fairly wide. As a result, a clearance for the band to rotate around must be designed into the body. Embodiments therefore provide a compact body that does not require a rotational path of the print interface while still allowing for the rotational path of the incorporated print bands.

When compared to self-inking daters of the prior art in which the date bands themselves actually move or rotate to engage the ink source and subsequently the receiving surface, embodiments of the present invention provide an ink-applying mechanism that moves, while the date bands or printing interface remains fixed.

In an embodiment, a retracting sheath encloses the rolling ink cartridge. In an embodiment, the protective sheath provides a protective shield over a portion of the ink cartridge, including but not limited to 40%-60% of the ink cartridge, that is exposed to the user at the bottom of the marking device. In an embodiment, when the marking device is in a neutral, non-printing position, the sheath closes and seals off the cartridge to prevent inadvertent access. In another embodiment, when the marking device is in a roller-changing position having a swingarm actuated outward, the sheath is in a closed position. Subsequently, when the roller is snapped into place within the swingarm, the motion of the placement or snapping into place opens the sheath. In operation, when the ink cartridge is moved via a swingarm to affect inking, the sheath is moved underneath the protective shield portion to allow inking of the die plate. Therefore, in another feature and advantage of embodiments of the invention, the user is protected from the risk of getting ink on his fingers, clothes, or other surrounding materials by the retracting sheath.

In an embodiment, a locking mechanism is provided that allows access to the ink roller or ink source in order to more easily change the ink source. In an embodiment, the locking mechanism secures the upper body in a depressed position such that the swingarm is actuated outward as it would be during inking and stamping. In another embodiment, the locking mechanism secures the swingarm itself when it is manually actuated outward by the user so that the upper body can remain in its extended neutral position.

In another embodiment of the invention, a die plate is pivotably mounted to a central support structure or date housing of the marking device. The die plate is mounted such that it pivots about a single pivot axis as the swing arm and ink roller pass over the die plate and print band(s) during a single actuation or stroke of the self-marking device. This allows for sufficient clearance of the swing arm from the die plate even after multiple uses so that smooth and easy actuation of the device is not inhibited.

In yet another embodiment of the invention, the ink roller assembly includes a swing arm similar to other embodiments and pivotably mounted on a lower housing of the self-marking device, an ink roller rotatably carried on the swing arm, and bearings on each end of the ink roller. An outer circumference of each bearing is configured to roll along a hard surface of the die plate so as to maintain the ink roller at a fixed distance from the die place creating a fixed amount of compression for the ink roller. Over-inking of the die plate and/or print band(s) is thereby reduced or avoided altogether.

In yet another embodiment of the invention, a die plate is height adjustable relative to the device so that customized dies formed on the die plate available from various manufactures can be utilized with the print bands. The height adjustability of the die plate allows the customized die characters or graphics to lie substantially flush with the die characters or graphics of the print bands to accommodate for potential variability of die heights due to differences in manufacturing processes for creating dies. A die plate is coupled to a die plate base via a plurality of adjustment cams. The adjustment cams are eccentric or oblong in cross-section such that as the cam is rotated, the die plate moves linearly, i.e. either up or down, relative to the die plate base and the print bands.

The above summary of the invention is not intended to describe each illustrated embodiment or every implementation of the present invention. The figures and the detailed description that follow more particularly exemplify these embodiments.

BRIEF DESCRIPTION OF THE DRAWINGS

The invention may be more completely understood in consideration of the following detailed description of various embodiments of the invention in connection with the accompanying drawings, in which:

FIG. 9A is a side view of a swingarm utilizing a coil spring, according to an embodiment.

FIG. 9B is a side view of a swingarm utilizing a compression spring, according to an embodiment.

FIG. 10 is a side view illustrating a plurality of possible swingarm lengths, according to embodiments.

Figure 1:
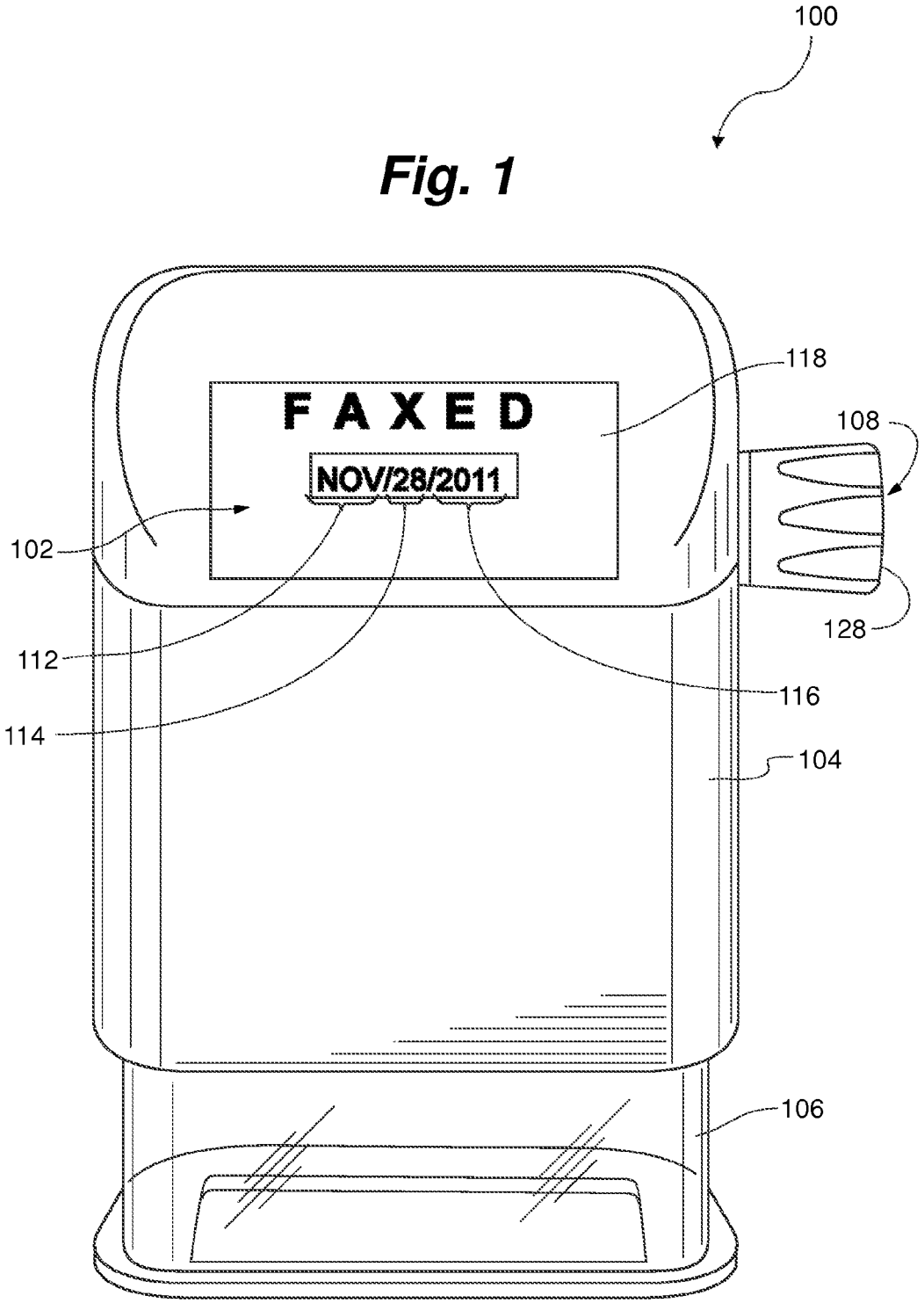
FIG. 1 is a front perspective view of a self-inking marking device, according to an embodiment.
Figure 2:
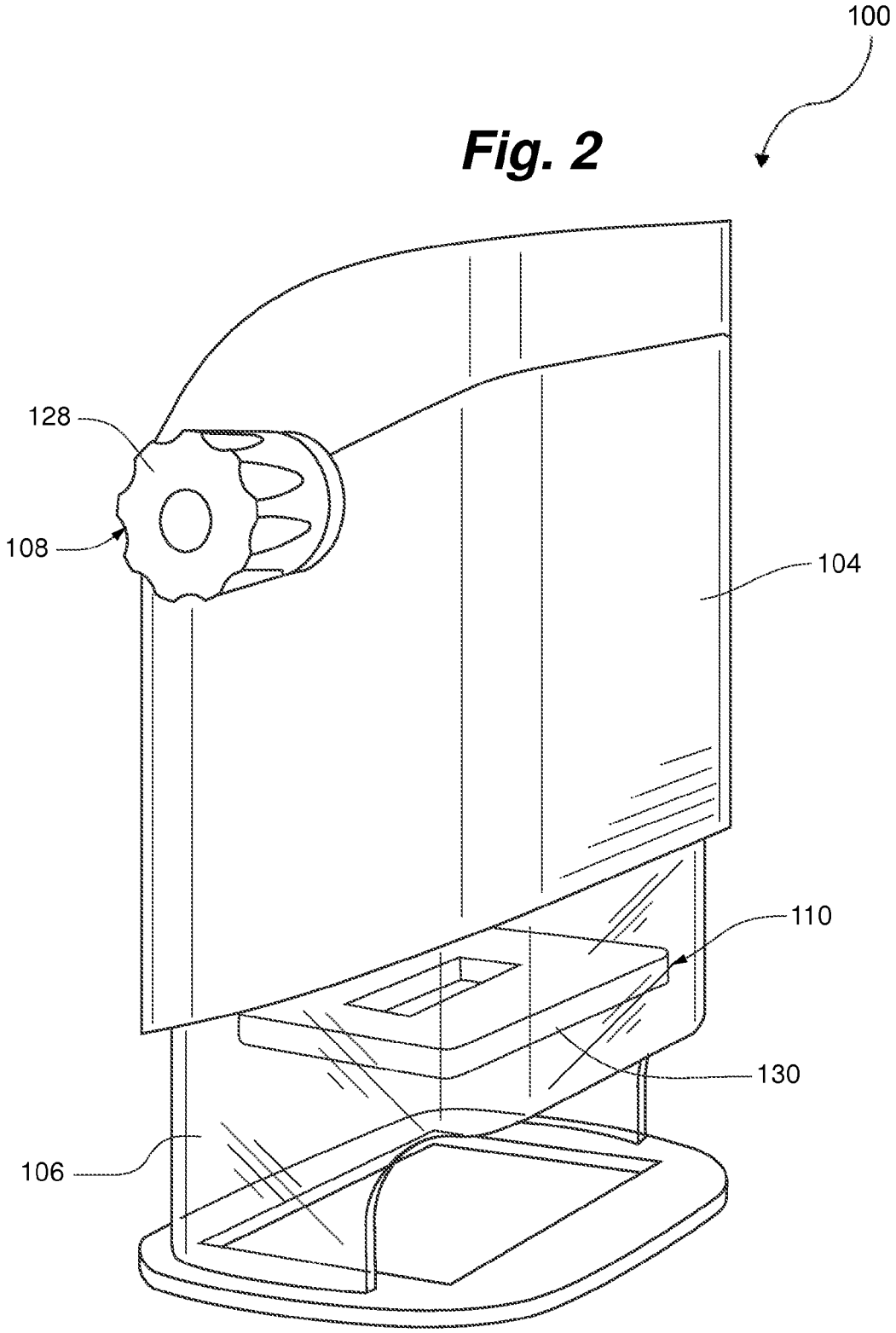
FIG. 2 is a rear-side perspective view of the self-inking marking device of FIG. 1.
Figure 3:
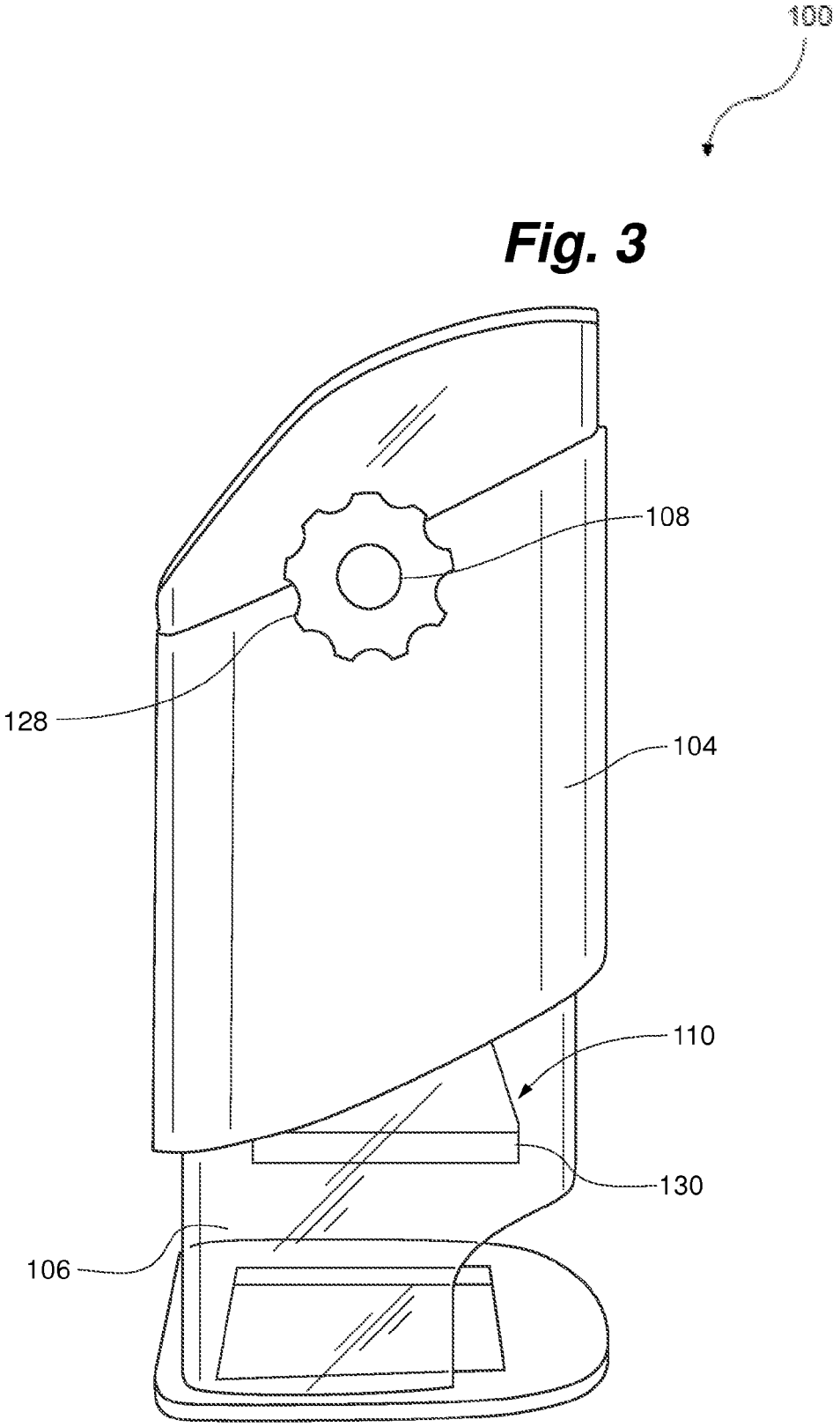
FIG. 3 is a side perspective view of the self-inking marking device of FIG. 1.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION

Referring generally to FIGS. 1-5, a self-inking marking or stamping device 100 according to an embodiment is depicted. Marking device 100 generally includes display interface 102, upper body 104, lower body 106, adjustment components 108, and printing components 110.

Display interface 102 comprises a month display 112, day display 114, year display 116, and optionally, a fixed or interchangeable display card 118. Month display 112 reflects the month value of the print band of months that is currently in the printing position. For example, in the embodiment depicted by FIGS. 1-5, month display 112 is "NOV" for November. Similarly, day display 114 reflects the day value of the print band(s) of days that is currently in the printing position. For example, in the embodiment depicted by FIGS. 1-5, day display 114 is "28," reflecting the $28^{th}$ day of the month. Likewise, year display 116 reflects the year value of the print band(s) of years that is currently in the printing position. For example, in the embodiment depicted by FIGS. 1-5, year display 116 is "2011" for the year 2011. It is understood that any of the alphanumeric values can have one or more bands that reflect discrete portions of a particular printing value, as will be described in detail below. For example, in an embodiment, referring to day display 114, a single print band can be utilized for values 1-31 of the possible numerical value of days. In another embodiment, a first print band is utilized for the ones value of a two-digit day, and a second print band is utilized for the tens value of the two-digit day. In embodiments, display values other than month, day, and year, corresponding to other print interfaces can be made up of one or more print bands. Further, each print band can comprise one or more alpha and/or numeric values, symbols, indicia, etc. Embodiments are not limited by the number of print bands or individual faces or indicia on the bands.

Month display 112, day display 114, and year display 116 can comprise display windows for revealing raised printed lettering, such as a rubber, foam, metallic, or other material suitable for such use. In embodiments, contrasting colors between the values and background can be utilized; for example black characters on a white background. Any combination of contrasts to distinguish values from their respective print band backgrounds are contemplated herein.

Display card 118 is positioned proximate month display 112, day display 114, and year display 116 to create an accurate depiction of the print interface when a detailed die is used to supplement the printed date. For example, in the embodiment depicted by FIGS. 1-5, display card shows "FAXED" to reflect the corresponding FAXED die currently in the printing position. In another embodiment, display card 118 can be blank, when no corresponding detailed die is used. In another embodiment, display card 118 can be fixed within display interface 102 such that it cannot be changed by the user.

In an embodiment, as depicted in FIGS. 1-5, display interface 102 is positioned at the top of marking device 100 and angled toward the user. Other display interface 102 positions and angles are also considered, such as on the side or back of a marking device, and at a steeper or less inclined angle, in embodiments.

Upper body 104 and lower body 106 comprise the walls that house the majority of adjustment components 108 and printing components 110, as well as provide the body of marking device 100. Upper body 104 comprises four walls and a face joined at the edges of the four walls, where a front wall and a back wall are parallel to each other, and a first sidewall and a second sidewall are parallel to each other such that the front wall is orthogonal to and joined to the two sidewalls and likewise, the back wall is orthogonal to and joined to the two sidewalls. The face encloses the space created by the four walls to create an enclosed area. In an embodiment, one end of upper body 104 that comprises the enclosing face can be rounded and angled to correspond to the angle of display interface 102. A second end can therefore be open to the interface to lower body 106 so that upper body 104 is slidably coupled to lower body 106. The body of upper body 104 between the first end and second end therefore comprise the length and further define the enclosed space. In embodiments, as shown in FIGS. 1-5, the second end can be angled at an angle similar to that of display interface 102 and the first end to create a more stylish-looking appearance. Optionally, the closed end of upper body 104 can be removable or hinged to the wall of upper body 104 so that access to display card storage 148 and display interface 102 is provided.

Lower body 106 comprises four walls with two open ends. A first end is located proximate upper body 104 such that the second end of upper body 104 overlaps portions of the first end of lower body 106. In an embodiment, the interior dimensions of upper body 104 are shaped just larger than the outside dimensions of lower body 106 such that each of the respective inner sides of upper body 104 make flush contact with a respective outer side of lower body 106. In another embodiment, a gap exists between the overlapping portions of upper body 104 and lower body 106 such that they are not in flush contact with each other. In other embodiments, contact is limited to certain raised portions of upper body 104 or certain raised portions of lower body 106 that establishes contact points or channels of movement. Optionally, lower body 106 comprises paths that direct the movement of upper body 104. A second end of lower body 106 is located distal upper body 104 to provide a printing area for marking device 100. The second end of lower body 106 is substantially transverse to the walls of upper body 104 and lower body 106 to create a flat surface to rest marking device 100 as well as to facilitate printing. Therefore, an open void within the body of upper body 104 and lower body 106 is created to house all or portions of adjustment components 108 and printing components 110 within marking device 100. Specifically, the space between the first end of upper body 104 and the second end of lower body 106 is configured to house all or portions of the aforementioned components. Lower body 106 further comprises, in embodiments, a roller access opening located within one of the walls of lower body 106. The roller access opening is configured to allow the roller to swing outside of the plane of the wall containing the roller access opening. Optionally, the void created by roller access opening can have a hinged cover.

In embodiments, upper body 104 and lower body 106 can comprise any number of shapes, configurations, or combinations of shapes. For example, two open-ended cylinders can comprise the body of marking device 100. Additionally, upper body 104 and lower body 106 can comprise only two walls respectively—a front wall and a backwall or two sidewalls, in embodiments, as desired. Further, upper body 104 and lower body 106 need not be symmetrical. Embodiments described herein are for illustration only and are in no way limiting.

Upper body 104 and lower body 106 are made of lightweight, translucent, opaque, or transparent plastic material, as depicted in FIGS. 1-5 in an embodiment, but can also comprise metal, composite, or any other appropriate material. For example, in industrial settings, sufficiently durable materials, such as reinforced steel, will be desirable when compared to the materials required in a typical office setting.

Figure 6:
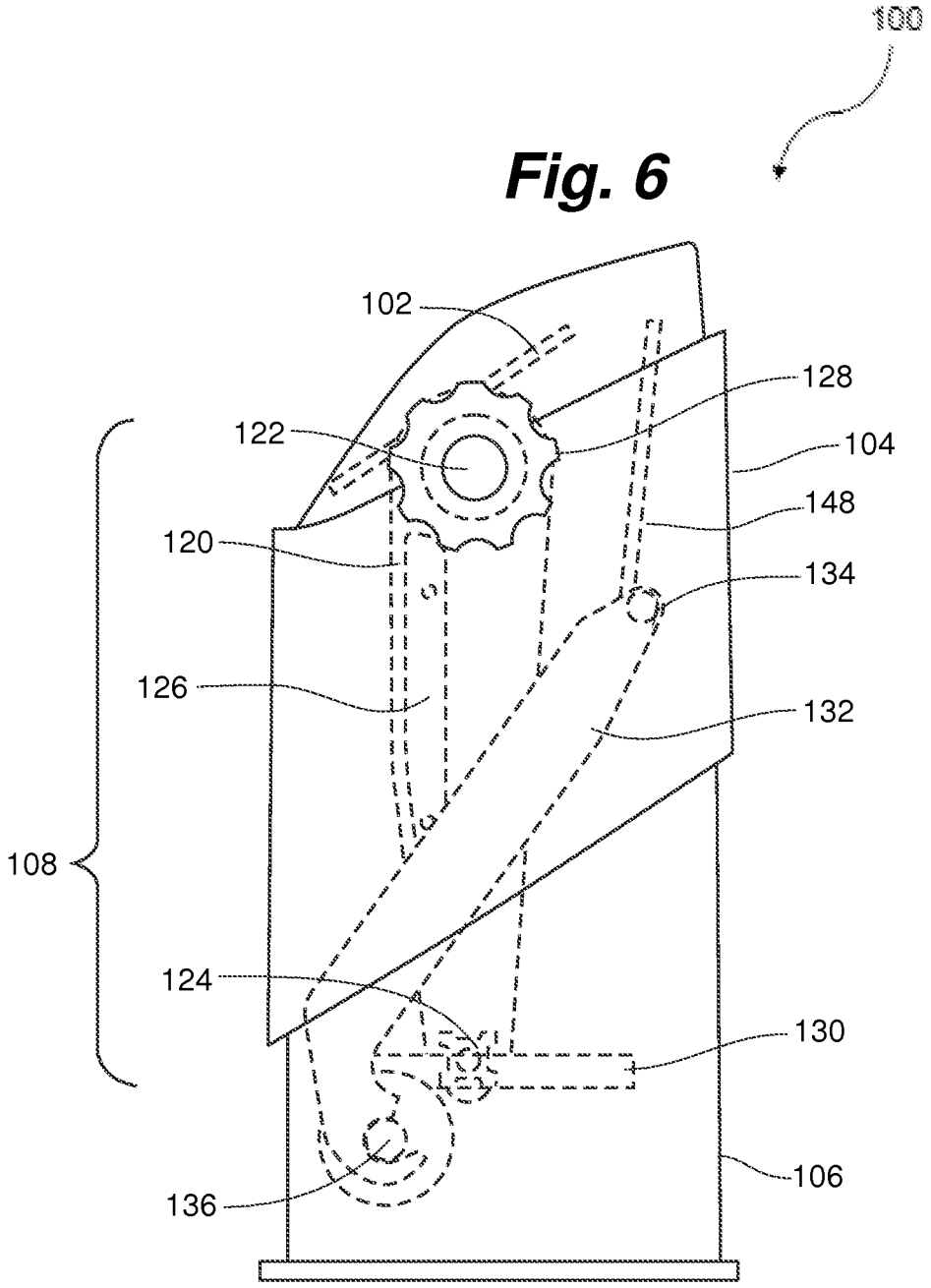
FIG. 6 is a side cross-sectional diagram of a self-inking marking device and associated components, according to an embodiment.

Referring to FIG. 6, adjustment components 108 comprises one or more date or print bands 120, upper roller or idler 122, lower roller or idler 124, date band buffer 126, and adjustment knob 128, in an embodiment.

Print band 120 comprises a loop of characters or values of individual print faces for printing and displaying. As shown, individual characters are linked together in a chain for rotation therethrough. In an embodiment, individual characters comprise raised printed lettering, made of, for example, a rubberized stamping material known in the industry. In embodiments, an individual print band 120 comprises a "print side" configured to be inked and to subsequently print on a receiving surface, as well as a corresponding opposite "read side" that is configured to display the opposing print side value in, for example, month display 112, day display 114, and year display 116. In an embodiment, the read side of print band 120 has contrasting colors for the values and background; for example black characters on a white background. Thus, read side characters and print side characters can differ on the same print band 120. In embodiments, the read side characters can be grouped together in a block opposite the print side characters such that every read side character is opposite its exact print side character on the print band 120. In another embodiment, read side characters and print side characters are mixed throughout print band 120.

Optionally, print band 120 further includes a hard stop that prevents rotation of a portion of print band 120 past upper roller 122, lower roller 124, or both. The hard stop thus inhibits rotation of print band 120 such that there is no possibility of over-rotating the read side into where the print side is normally positioned, or the print side into where the read side is normally positioned. As a result, display interface 102 and, more particularly, month display 112, day display 114, and year display 116 are kept ink-free.

Upper roller 122 comprises a cylinder configured to interface with one or more print bands 120. In an embodiment, upper roller 122 comprises one end of the rotational mechanism for print band 120, with lower roller 124 providing the opposite end. Upper roller 122 and lower roller 124 therefore provide the ends to keep one or more print bands 120 taut in a relative loop or circular configuration. Upper roller 122 is positioned, in an embodiment, proximate display interface 102, and specifically, month display 112, day display 114, and year display 116 so that characters of print band 120 can be viewed when positioned at a particular position relative to upper roller 122 through display interface 102. The values or characters of print band 120 that rotate proximate upper roller 122 are therefore read side characters for displaying. Upper roller 122 is operably coupled to adjustment knob 128, as will be described below, so that when the user rotates adjustment knob 128, upper roller 122 is likewise rotated. As a result, print band 120 is also rotated.

Lower roller 124 comprises a cylinder configured to interface with one or more print bands 120. In an embodiment, as described, lower roller 124 comprises one end of the rotational mechanism for print band 120, with upper roller 122 providing the opposite end. Lower roller 124 is positioned, in an embodiment, proximate printing components 110, and specifically, die plate 130, so that characters of print band 120 are substantially flush with a print side **130*a* of die plate 130. In embodiments, die plate 130, and particularly print side 130*a*, comprises a supporting surface configured to support a die, the die having indicia of any matter, including, but not limited to alphanumeric, text, graphics, images, patterns, and other indicia. Lower roller 124 is therefore configured to position characters of print band 120 such that the characters can be inked along with any indicia of the die incorporated on print side 130*a* of die plate 130, and subsequently marked onto a receiving surface. The values or characters of print band 120 that rotate proximate lower roller 124** are therefore print side characters for printing or stamping. In one specific embodiment, the print side characters are in wrong-read format, or in other words, create an image or text that is backwards when compared to the receiving-surface printed image or text.

Upper roller 122 is depicted in FIG. 6 as having a larger circumference than lower roller 124. However, other roller size configurations are possible. Further, additional rollers can be utilized if desired in a particular marking application. Additionally, upper roller 122 and lower roller 124 can be segmented into sections that are associated with each individual print band 120, so that when a particular print band 120 is selected, those associated sections of upper roller 122 and lower roller 124 are subsequently rotated.

Date band buffer 126 acts in a dual function. In a first function, date band buffer 126 comprises a separator having fins between one or more print bands 120. In an embodiment, date band buffer 126 comprises a thin strip positioned lengthwise with print bands 120 at each gap between print bands 120. One end of a particular date band buffer 126 is positioned proximate upper roller 122, with a second end positioned intermediate the length of print band 120 between upper roller 122 and lower roller 124. Thus, in a first function, date band buffer 126 maintains print band 120 alignment. In a second function, date band buffer 126 changes the angle of print bands 120 such that the travel length is increased. As a result, date band buffer 126 allows the read side of print band 120 to be in a desired angled orientation. Because, without date band buffer 126, in embodiments, print band 120 comprises a read side exactly opposite a corresponding print side, when a print side value is in the print interface, the corresponding read side would be positioned facing directly up across the diameter of print band 120. Adjustment without date band buffer 126 would only be possible in increments of the indicia face segment height. Date band buffer 126 therefore provides the desired angled orientation by offsetting the travel length of the band 120. In embodiments, date band buffer 126 can be made of flexible or rigid plastic, metal, or any other suitable material.

Adjustment knob 128 comprises a substantially cylindrical interface to the user that projects from upper body 104. Adjustment knob 128 is operably coupled to upper roller 122 to affect selection of print bands 120 along upper roller 122 as well as rotation of upper roller 122 and, in turn, individual print bands 120. In an embodiment, upper roller 122 and adjustment knob 128 share the same axis. Similarly, in embodiments, upper roller 122 can likewise extend from upper body 104 such that adjustment knob 128 encloses the projection portion of upper roller 122. In another embodiment, adjustment knob 128 comprises an interface that extends from outside upper body 104 to inside upper body 104 when upper roller 122 is positioned fully within upper body 104. In embodiments, adjustment knob 128 provides an adjustment interface that identifies the particular print band 120 under adjustment. In an embodiment, adjustment knob 128 is operably coupled to a shaft that passes through a series of idler wheels on which the display portion of print bands 120 ride. The idler wheels have indexing features on the outer circumference that act as locating detents to retain the print band 120 selection and which further provide tactile feedback while the user cycles through date band selections. The inner surface of the idler wheels have keyways (slots) which interface with keys (tabs) on the adjustment knob 128 shaft which positively drive the selected idler wheel. One band can be adjusted at a time, and the driven band 120 is selected by moving adjustment knob 128 toward and away from upper body 104, along an axis that is coincident with the center of the idler wheel set.

In embodiments, adjustment knob 128 is configured to move transverse to upper body 104 to select the desired print band 120 for adjustment. Adjustment knob 128 is configured to be moved proximate to upper body 104 as well as distal to upper body 104. When the desired print band 120 is selected, adjustment knob 128 is configured to be rotated, which in turn causes that particular print band 120 to be rotated. In an embodiment, adjustment knob 128 can have raised gripping projections that provide additional enhanced interfaces for the user when rotation or transverse adjustment is desired. In other embodiments, adjustment knob 128 can comprise a wheel, button, lever, or other appropriate interface that is configured to allow adjustment of print bands 120.

In embodiments, marking device 100 comprises a plurality of adjustment knobs 128. A first adjustment knob 128 comprises a substantially cylindrical interface to the user that projects from upper body 104. First adjustment knob 128 is operably coupled to a first upper roller 122 to affect selection of a first set of print bands 120 along first upper roller 122 as well as rotation of first upper roller 122 and, in turn, individual print bands 120 of the first set. Likewise, a first lower roller 124 provides the opposite end of the rotational mechanism for the first set of print bands 120. Marking device 100 further comprises a second adjustment knob 128 that comprises a substantially cylindrical interface to the user that projects from upper body 104 at a location proximate first adjustment knob 128. In another embodiment, second adjustment knob 128 projects from a side opposite first adjustment knob. Second adjustment knob 128 is operably coupled to a second upper roller 122 to affect selection of a second set of print bands 120 along second upper roller 122 as well as rotation of second upper roller 122 and, in turn, individual print bands 120 of the second set. Likewise, a second lower roller 124 provides the opposite end of the rotational mechanism for the second set of print bands 120. In other embodiments, additional adjustment knobs 128, corresponding print bands 120, and upper rollers 122 are provided. Therefore, a plurality of additional lines of print can be provided.

Printing components 110 comprises die plate 130, swingarm 132, swingarm pivot 134, ink roller cartridge 136, first free space zone 138, and second free space zone 140.

Die block or plate 130 comprises an apertured plate having a smooth machined surface. Effectively, die plate 130 provides a surface to operably couple dies that complement the adjustable or variable data imprinted by print bands 120. Various dies can be affixed to die plate 130. In other embodiments of marking device 100, die plate 130 does not include a die and thus die plate 130 is left empty. In such embodiments, when inking, ink roller cartridge 136 does not contact anything until it rolls across print bands 120. In an embodiment, as depicted in FIG. 6, die plate 130 is positioned proximate lower roller 124 and also proximate ink roller cartridge 136 such that die plate 130 is intermediate lower roller 124 and ink roller cartridge 136. Further, as mentioned, lower roller 124 is positioned proximate die plate 130 such that individual characters from one or more print bands 120 can be inked to form the print side of print bands 120. Thus, the aperture created within die plate 130 is configured to contain the currently-selected print band 120 values. Because the individual characters of print bands 120 are adjustable in and out of the print interface, and further because a single row of characters is selected as the printing values at any one time, a smooth, larger die plate is useful in preventing or inhibiting wear on ink roller cartridge 136.

In another embodiment, marking device 100 does not include die plate 130. In such an embodiment, when inking, ink roller cartridge 136 only contacts print bands 120, similar to embodiments where no die is affixed to die plate 130. In embodiments, because the surfaces that ink roller cartridge 136 rolls on is independent of die plate 130, it is immaterial if dies proximate the print band 120 print side values are in place or not. Ink roller cartridge 136 is correctly spaced to ink the print band 120 values regardless. In embodiments, ink roller cartridge 136 can include a registration method to return ink roller 136 to a known neutral position such that wear on ink roller cartridge 136 can be spread across the circumference of the cartridge 136.

Swingarm 132 is substantially L-shaped in an embodiment and comprises a swingarm body 142, a projecting portion 144, and a yoke 146. Referring specifically to FIGS. 6, 9A, 9B, and 10, swingarm body 142 extends at a first end from swingarm pivot 134 to projecting portion 144 at a second end. In an embodiment, an aperture within swingarm body 142 couples to swingarm pivot 134. Projecting portion 144 extends from the second end of swingarm body 142 at an angle. Myriad lengths of swingarm body 142 and projecting portion 144 are possible, and therefore myriad angles of connection between swingarm body 142 and projecting portion 144 are possible. Yoke 146 is positioned at the end of projecting portion 144 distal swingarm body 142 and comprises a forking frame configured to operably couple to ink roller cartridge 136. In embodiments, the components of swingarm 132 can be made of any rigid or semi-rigid material, such as plastic or metal. In an embodiment, swingarm 132 can be operably coupled to upper body 104. In another embodiment, swingarm 132 can be operably coupled to lower body 106. In other embodiments, swingarm 132 can be operably coupled to both upper body 104 and lower body 106. In an embodiment, swingarm 132 comprises a spring-actuated release mechanism that is configured to grip, or when appropriate, release ink roller mechanism 136. Referring specifically to FIG. 10, swingarm body 142 can be of varying lengths, depending on the marking device 100 application. For example, swingarm 132*a* comprises a shorter swingarm body 142. Such a configuration allows for a longer upper stroke and a higher force span at the ink roller cartridge 136-die plate 130 interface. At the opposite end, swingarm 132*c* comprises a longer swingarm body 142. Such a configuration allows for a shorter upper stroke and a lower force span at the ink roller cartridge 136-die plate 130 interface. Swingarm 132*b* comprises an intermediate swingarm body 142, and thus has characteristics intermediate swingarm 132*a* and 132*c*.

In an embodiment, a single swingarm 132 is positioned at an end of ink roller cartridge 136 such that ink roller cartridge extends and is supported in a cantilevering manner. In another embodiment, one swingarm 132 is positioned at one end of ink roller cartridge 136 and a second swingarm 132 is positioned opposite the first swingarm 132 on a second side of ink roller cartridge 136 such that ink roller cartridge 136 is supported on each side, thus forming more of a spindle-type subcomponent. Swingarm pivot 134, in an embodiment, comprises an aperture within swingarm body 142 in combination with a pin or other rotatable projection point fastener. Swingarm pivot 134 therefore allows swingarm 132, via swingarm body 142, to rotate about the axis provided by the pin.

Myriad options exist for providing force against ink roller cartridge 136 via swingarm 132 and about swingarm pivot 134 in order to take advantage of the actuation of marking device 100 to ink die plate 130 and return ink roller cartridge 136 to a neutral position. Two such options are laid out in FIGS. 9A and 9B. Referring to FIG. 9A, a coil spring 148 can be positioned about swingarm pivot 134 and operably coupled to swingarm body 142 and components of upper body 104. Referring to FIG. 9B, a compression spring 150 can be operably coupled to swingarm body 142 at one end and a component of upper body 104 at a second end. Coil spring 148 and compression spring 150 are thus configured to provide tension such that when swingarm 132 is actuated, force is directed through swingarm 132 and towards die plate 130. Coil spring 148 or compression spring 150 therefore create a force that holds ink roller cartridge against die plate 130. Likewise, when swingarm 132 is returned from actuation, swingarm body 142, projecting portion 144 and thus, ink roller cartridge 136 is returned to a neutral position away from die plate 130. Optionally, in an embodiment, lower body 106 can further comprise a track or guide aperture that is configured to stabilize the movement of ink roller cartridge 136. Ink roller cartridge 136 comprises an ink-containing cylinder core with a porous, ink-distributing surface wrapped about the core. In an embodiment, the porous ink-distributing surface comprises a foam material. Other known ink-distributing materials can also be utilized. In an embodiment, ink roller cartridge 136 comprises a hollow through-axis aperture extending from one end of the cylinder to the opposite end of the cylinder. In another embodiment, the cylinder core is configured to be hollow for purposes of housing a spring mechanism that can secure ink roller cartridge 136 into swingarm 132. The spring mechanism in such embodiments pushes outward causing the ends of the cylinder to apply force on one or more swingarms 132, thus holding ink roller cartridge 136 in place. In another embodiment, a porous material acts as the ink-distributing surface as well as the ink-containing material. Thus, in such embodiments, there is no core. In embodiments, a 2 mm thick porous material completely contains the ink within the porous material. In embodiments, the ends of the cylinder core of ink roller 136 extend further than the porous, ink-distributing surface wrapped about the core. In other embodiments, the ends of the cylinder core of ink roller 136 extend to approximately the same length as the porous, ink-distributing surface wrapped about the core.

Ink roller cartridge 136 is operably coupled to yoke 146, and thus positioned proximate die plate 130. In an embodiment, the hollow through-axis aperture is utilized in combination with a post that can be placed through the through-axis aperture such that the post extends on one or both sides of ink roller cartridge 136. The forks of yoke 146 can thus couple to the post, allowing ink roller cartridge 136 to freely rotate about the through-axis aperture.

In an embodiment, ink roller cartridge 136 can comprise a porous layer divided between two sections to have a different ink color on each section. In operation, as ink roller cartridge 136 rolls across die plate 130, for example, then print bands 120, a first section having a red ink would first contact print bands 120, then contact die plate 130 with a second section having a blue color. In this way, multi-color impressions can be created on the receiving surface. In embodiments, a registration method is implemented to return ink roller 136 to a known neutral position. This known neutral position would thus provide the same color scheme to every receiving surface at every marking. Continuing the example above, ink roller 136 would be returned so that at the next first contact and subsequent rotation, print bands 120 are first contacted again with the first section having red ink, and the die plate 130 is subsequently contacted again with the second section having blue ink. In other embodiments, ink roller cartridge 136 can comprise a porous layer having a plurality of sections in order to have a plurality of different ink colors.

In another embodiment, ink roller cartridge 136 is not a roller but comprises a flat ink pad (not shown). In embodiments, the print interface can be inked similar to that with ink roller 136, by upper body 104 movement and subsequent actuation of swingarm 132 about swingarm pivot 134. In such an embodiment, as swingarm 132 is actuated, the flat ink pad is swung towards die plate 130, where pressure is applied into die plate 130, thus inking die plate 130 and print bands 120. As upper body 104 movement continues, the flat ink pad is subsequently moved from ink pad 130, thus allowing print bands 120 and die plate 130, if installed, to contact the receiving surface. In an embodiment, the flat ink pad is configured to swivel in one or more locations to allow the ink pad to more easily clear die plate 130 and/or print bands 120. In embodiments, a coupling mechanism operably coupling the ink pad to the actuating swingarm is configured to swivel in one or more locations to allow the ink pad to more easily clear die plate 130 and/or print bands 120, in combination with or separate from, the aforementioned swivel of the flat ink pad.

Figure 7A:
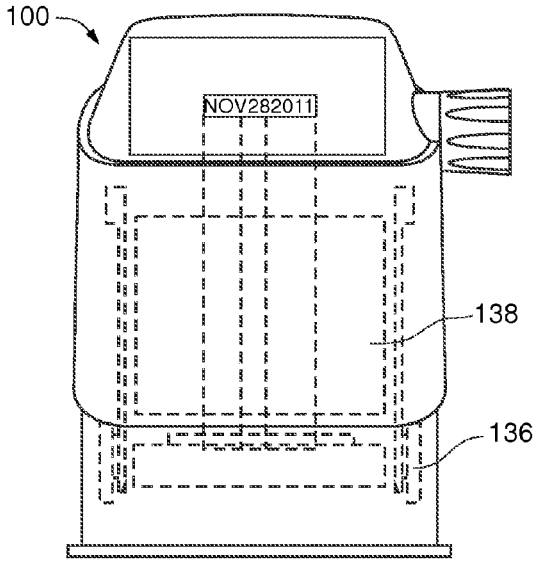
FIG. 7A is a front cross-sectional diagram of a self-inking marking device highlighting a first free space zone for a body return spring, according to an embodiment.
Figure 7B:
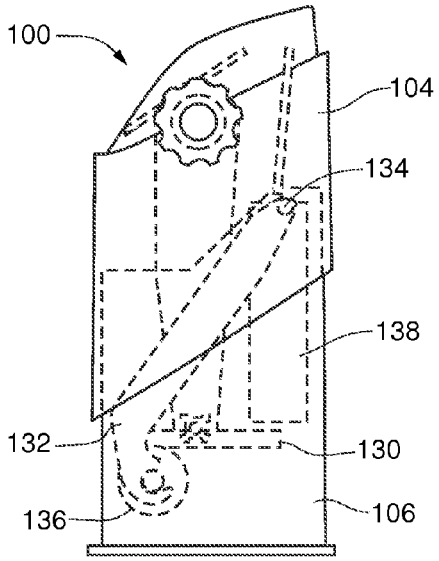
FIG. 7B is a side cross-sectional diagram of the self-inking marking device of FIG. 7A highlighting the same first free space zone for a body return spring as FIG. 7A.
Figure 11A:
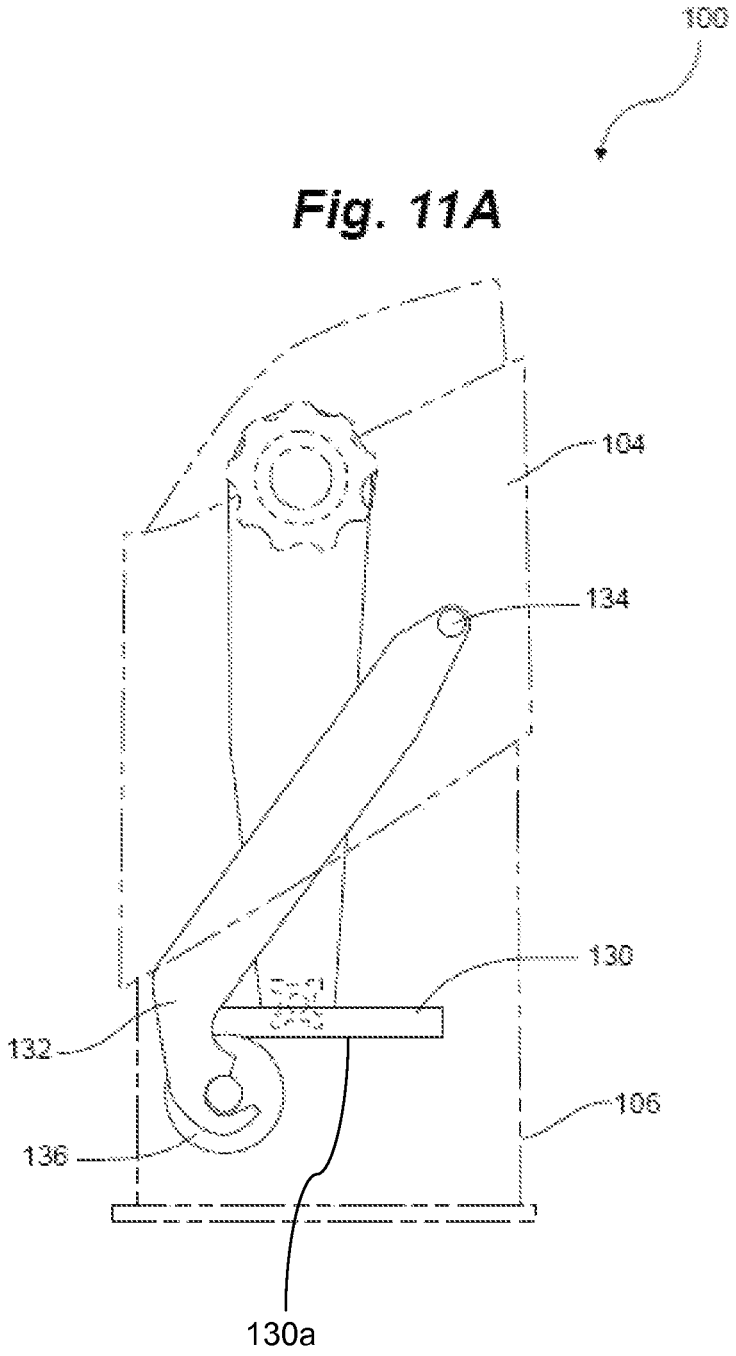
FIG. 11A is a side cross-sectional diagram of a self-inking marking device in a neutral position, according to an embodiment.
Figure 11B:
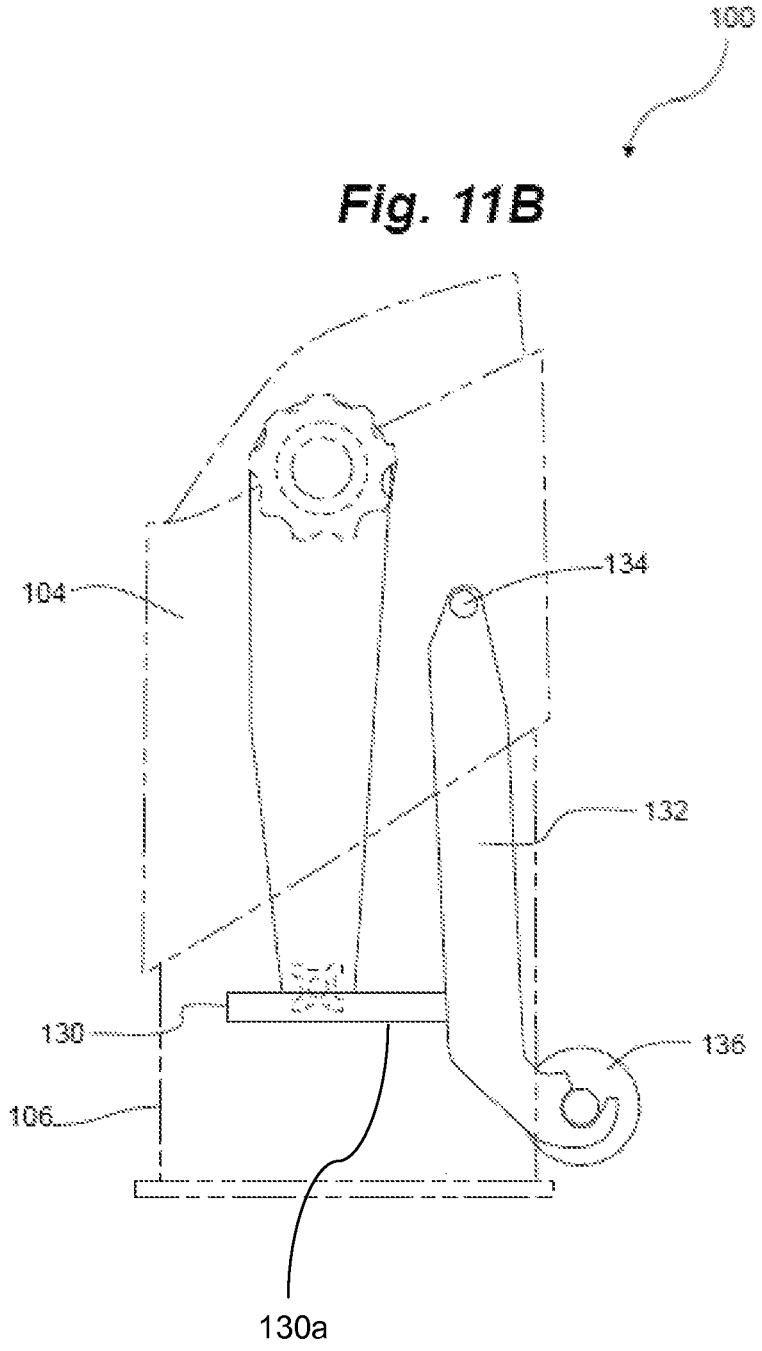
FIG. 11B is a side cross-sectional diagram of the self-inking marking device of FIG. 11A with a swingarm manually actuated outward.
Figure 11C:
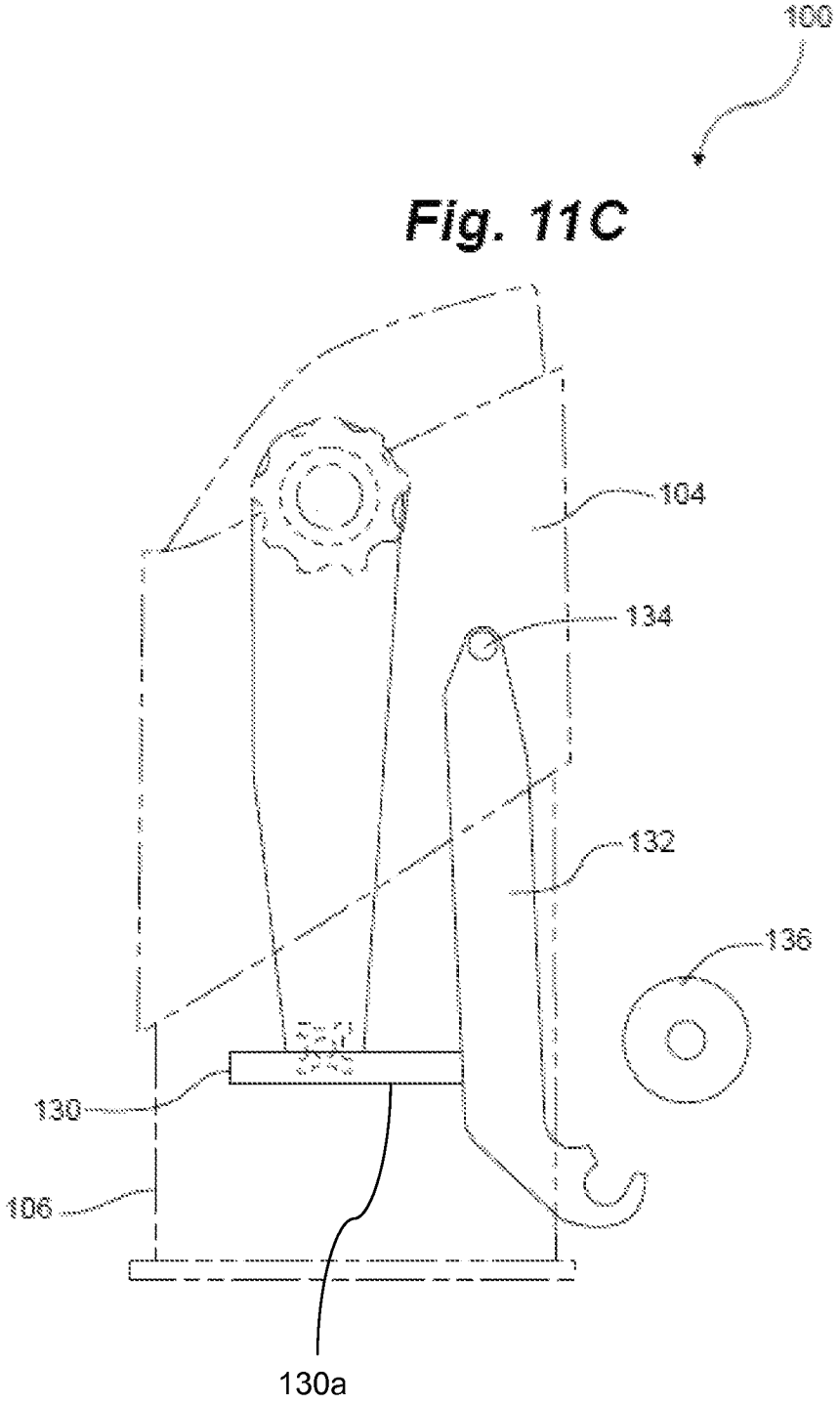
FIG. 11C is a side cross-sectional diagram of the self-inking marking device of FIG. 11B with an ink roller cartridge removed from a swingarm yoke.

Referring to FIGS. 11A-11C, the movement of swingarm 132 about swingarm pivot 134 when not actuated by the marking device, but instead manually actuated by the user, is illustrated. First, referring to FIG. 11A, marking device 100 is in a neutral position. Upper body 104 is fully extended distal lower body 106 and as a result, swingarm 132 is positioned about swingarm pivot 134 with the force of, for example, coil spring 148 or compression spring 150 such that ink roller cartridge 136 is proximate die plate 130 but not touching any of print bands 120 that extend through the aperture of die plate 130. Referring to FIG. 11B, marking device 100 has swingarm 132 manually actuated outward. Swingarm 132 is pivoted about swingarm pivot 134 with the maximum distance from the neutral position of FIG. 11A. Ink roller cartridge 136 is therefore extended via projecting portion 144 and yoke 146 outside of the plane formed by lower body 106. Referring to FIG. 11C, ink roller cartridge 136 is removed from yoke 146 with swingarm 132 manually actuated outward. In this way, ink roller cartridge 136 can be replaced. Alternatively, in an embodiment, a locking mechanism can be utilized while replacing ink roller cartridge 136. In an embodiment, the locking mechanism secures upper body 104 when in a depressed position such that swingarm 132 is actuated and held outward. In another embodiment, the locking mechanism secures swingarm 132 itself when swingarm 132 is manually actuated outward by the user. In this embodiment, upper body 104 remains in its extended neutral position. First free space zone 138, referring to FIGS. 7A and 7B, is a void intentionally created within upper body 104 and lower body 106 along the wall proximate swingarm pivot 134. First free space zone 138 provides space for the body action return springs that cause upper body 104 to return to a neutral position from lower body 106. In embodiments, this void also allows for the free movement of swingarm body 142 about swingarm pivot 134, and specifically the portion of swingarm body 142 proximate swingarm pivot 134.

Figure 8A:
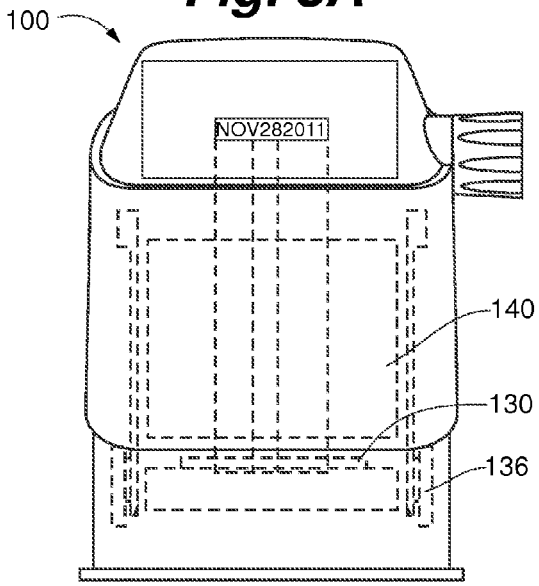
FIG. 8A is a front cross-sectional diagram of a self-inking marking device highlighting a second free space zone for a body return spring, according to an embodiment.
Figure 8B:
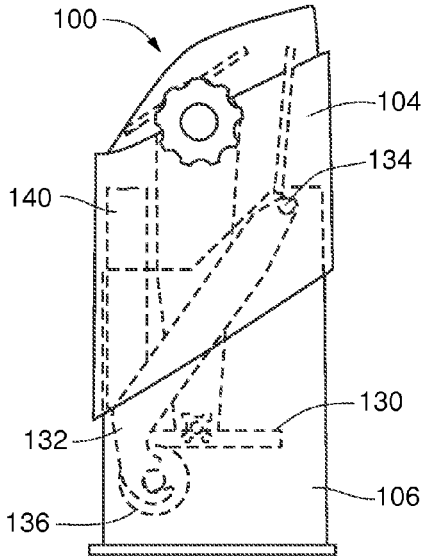
FIG. 8B is a side cross-sectional diagram of the self-inking marking device of FIG. 8A highlighting the same second free space zone for a body return spring as FIG. 8A.

Similarly, second free space zone 140, referring to FIGS. 8A and 8B, is a void intentionally created within upper body 104 and lower body 106 along the wall distal swingarm pivot 134 and proximate the elbow formed by the connection of swingarm body 142 and projecting portion 144. Second free space zone 140 also provides space for the body action return springs that cause upper body 104 to return to a neutral position from lower body 106. In embodiments, this void also allows for the free movement of swingarm body 142 about swingarm pivot 134, and specifically the elbow portion of swingarm 132 formed by the connection of swingarm body 142 and projecting portion 144.

Figure 4:
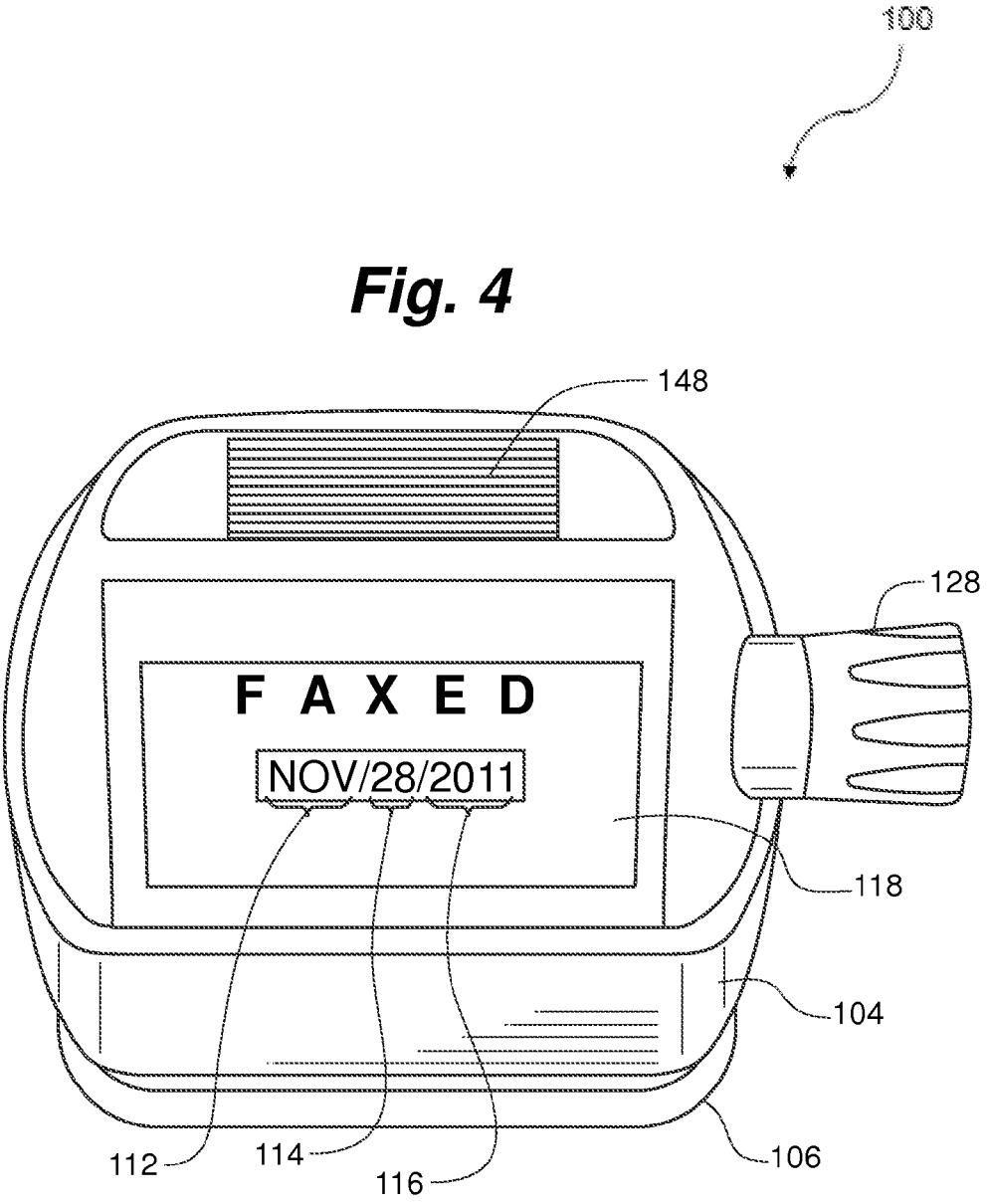
FIG. 4 is a top-front perspective view of the self-inking marking device of FIG. 1.
Figure 5:
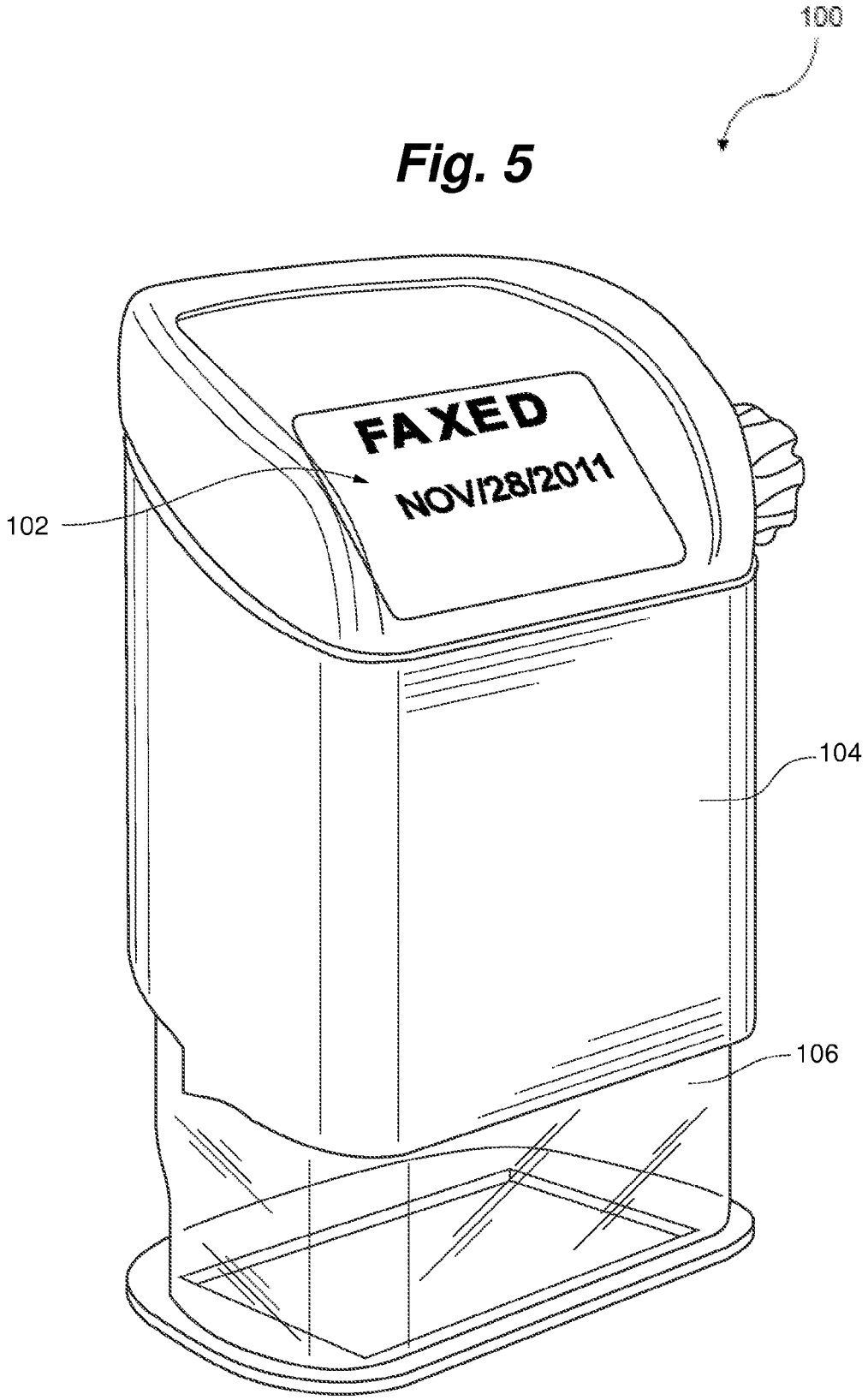
FIG. 5 is a front-side perspective view of the self-inking marking device of FIG. 1.

Optionally, marking device 100 can further comprise a display card storage 148. Referring to FIGS. 4 and 6, in an embodiment, display card storage 148 comprises a void located within upper body 104 that is dimensioned to hold unused display cards 118. In the embodiment of FIGS. 4 and 6, display card storage 148 is located opposite display interface 102 within the first side of upper body 104, and is substantially hidden by the angle of display interface 102. Display card storage 148 can be located elsewhere within the body of marking device 100 in embodiments.

In operation, referring generally to FIGS. 1-6, a user first selects a desired print interface. Specifically, the user can examine display interface 102 to learn the current print interface settings. If desired, the user can replace die plate 130 with another die plate 130 in the case that the current die plate displays a supplemental status, such as "FAXED." In another embodiment, an individual die can be replaced on die plate 130. Individual dies can therefore be mechanically or adhesively attached to die plate 130. Likewise, the corresponding display card can be changed by accessing display card storage 148 and the stored display cards.

Assuming die plate 130 is now acceptable to the user, the user can adjust one or more print bands 120 using adjustment knob 128. Adjustment knob 128 can be positioned between the user's thumb and forefinger or thumb and middle finger. If the user wishes to update the value furthest to the user's left, for example, month display 112 in FIGS. 1-5, adjustment knob 128 can be pushed transverse to upper body 104 in the direction of upper body 104 until it is in the month adjustment position. As described above, the proper positioning can be indicated by tactile response or visual indication on display interface 102, in embodiments. Within marking device 100, when adjustment knob 128 is pushed transverse to upper body 104, the adjustment interface of adjustment knob 128 to print band 120 is set to the corresponding months print band 120 to identify the months print band 120 as the print band 120 under adjustment. This can be done, for example, via operation of the segmented upper roller 122 and segmented lower roller 124.

Adjustment knob 128 can then be rotated to adjust the month value shown in month display 112. Internally, the months print band 120 is rotated in the loop from upper roller 122 to lower roller 124 by operation of adjustment knob 128. During rotation, display interface 102 is updated every time a new value of print band 120 is positioned in month display 112. Similarly, during rotation, the print interface within die plate 130 is updated to reflect the same value as shown in display interface 102 and month display 112. Print band 120 is rotated in this way until the desired setting is obtained.

Once the months setting has been attained, adjustment knob 128 can then be again moved transverse to upper body 104 to select another print band 102 for adjustment. Likewise, adjustment knob 128 can then again be rotated, which in turn causes the newly-chosen print band 120 to be rotated. In this way, the print interface can be adjusted.

Figure 12B:
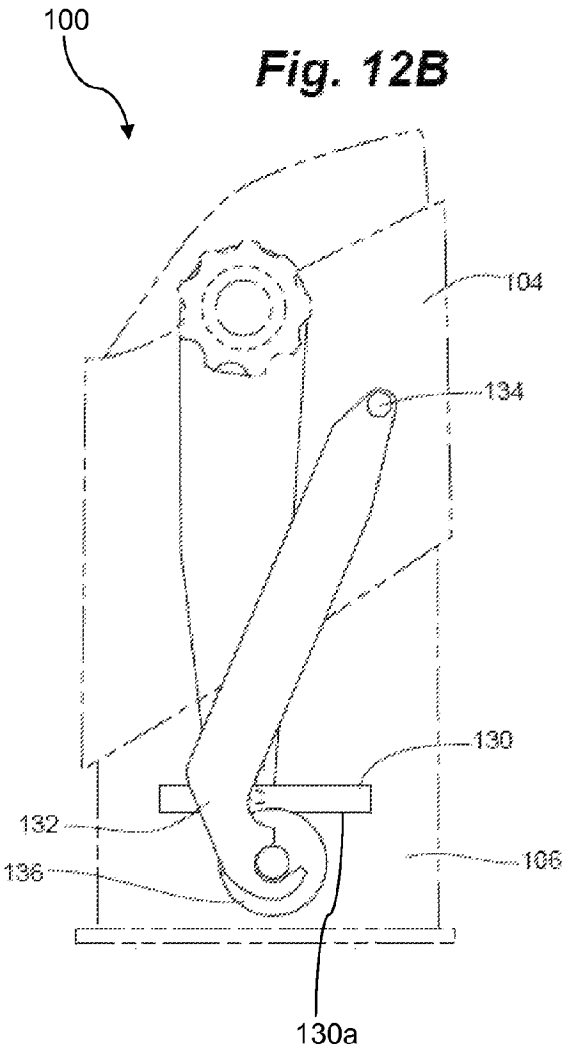
FIG. 12B is a side cross-sectional diagram of the self-inking marking device of FIG. 12A in an intermediate operational position.
Figure 12A:
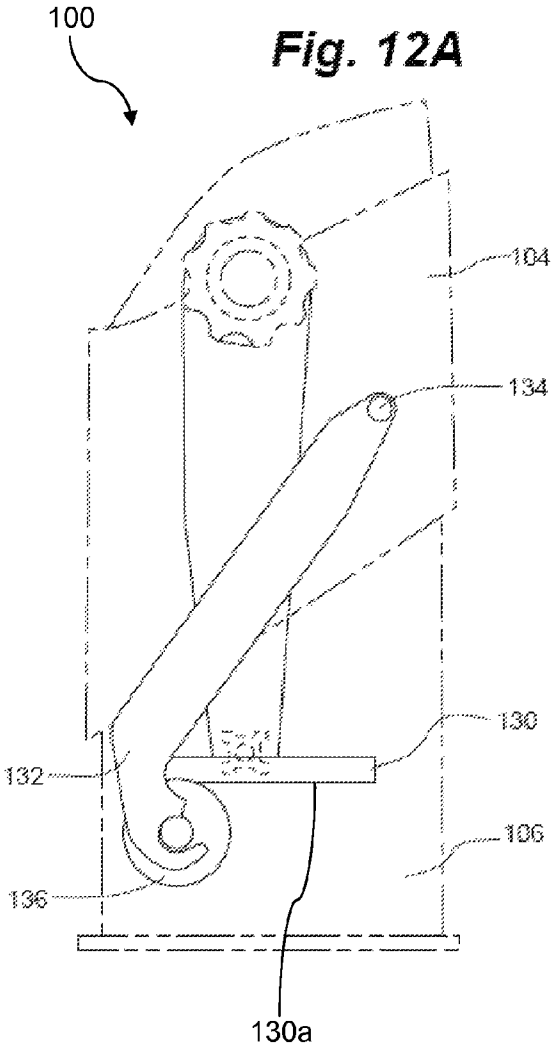
FIG. 12A is a side cross-sectional diagram of a self-inking marking device in a neutral position, according to an embodiment.

Referring to FIGS. 12A-12D, after the desired print interface has been adjusted and set as described above, marking device 100 can be actuated to provide an imprint on a receiving surface. Referring specifically to FIG. 12A, the imprinting process begins with marking device 100 in a neutral position. In this position, the user arranges marking device 100 to the location on the receiving surface where an imprint is desired. Note that in this neutral position, upper body 104 is fully extended distal lower body 106 and as a result, swingarm 132 is positioned about swingarm pivot 134 with the force of, for example, coil spring 148 or compression spring 150 such that ink roller cartridge 136 is proximate die plate 130 but not touching any of print bands 120 that extend through the aperture of die plate 130.

Referring to FIG. 12B, the actuation process is initiated. The user applies force to the top of marking device 100, and specifically to upper body 104 in a direction parallel to the projection of lower body 106 and upper body 104 (and orthogonal to the receiving surface). Upper body 104 is therefore pushed toward lower body 106. Coil spring 148 or compression spring 150, in embodiments, acts upon swingarm 132 to force ink roller cartridge 136, via swingarm body 142 and projecting portion 144, to move in a direction across die plate 130. Force is transferred, in an embodiment, through the larger diameter elements of ink roller cartridge 136 at either end. Ink roller cartridge 136 acts as a roller riding along the surfaces on either side of die plate 130 area. Force from swingarm 132, which varies slightly through the path of travel during an actuation process cycle, is transferred through the larger diameter elements of ink roller cartridge 136 instead of the inked surface in order to precisely control the spacing and force of ink roller cartridge 136 on the print interface of die plate 130 and print bands 120. In FIG. 12B, ink roller cartridge 136 has moved about halfway across die plate 130, and has nearly completed inking the print side of print bands 120 that have been rotated into the print interface. Die plate 130 is also lowered.

Figure 12D:
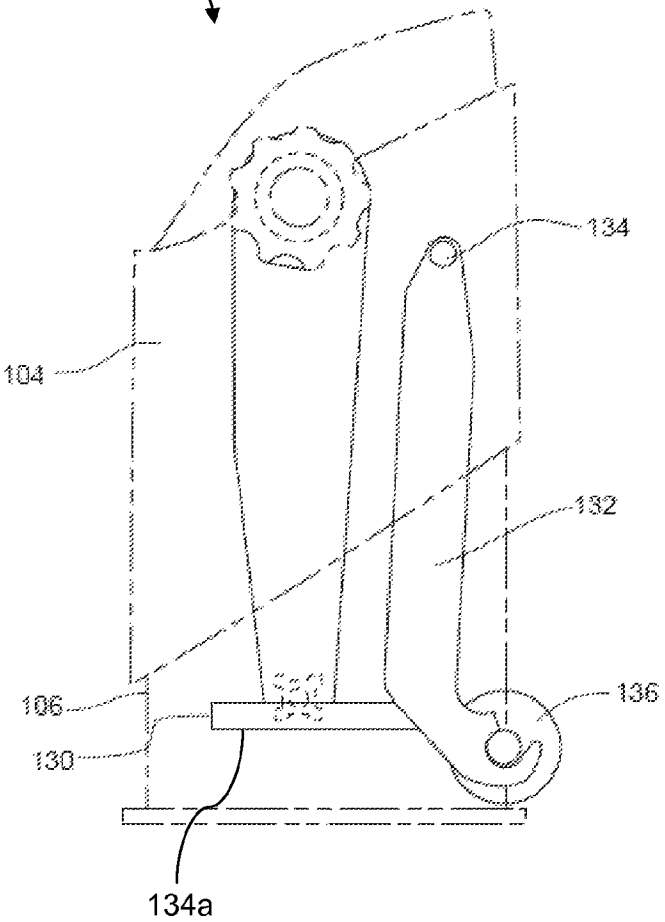
FIG. 12D is a side cross-sectional diagram of the self-inking marking device of FIG. 12A in an intermediate operational position.
Figure 12C:
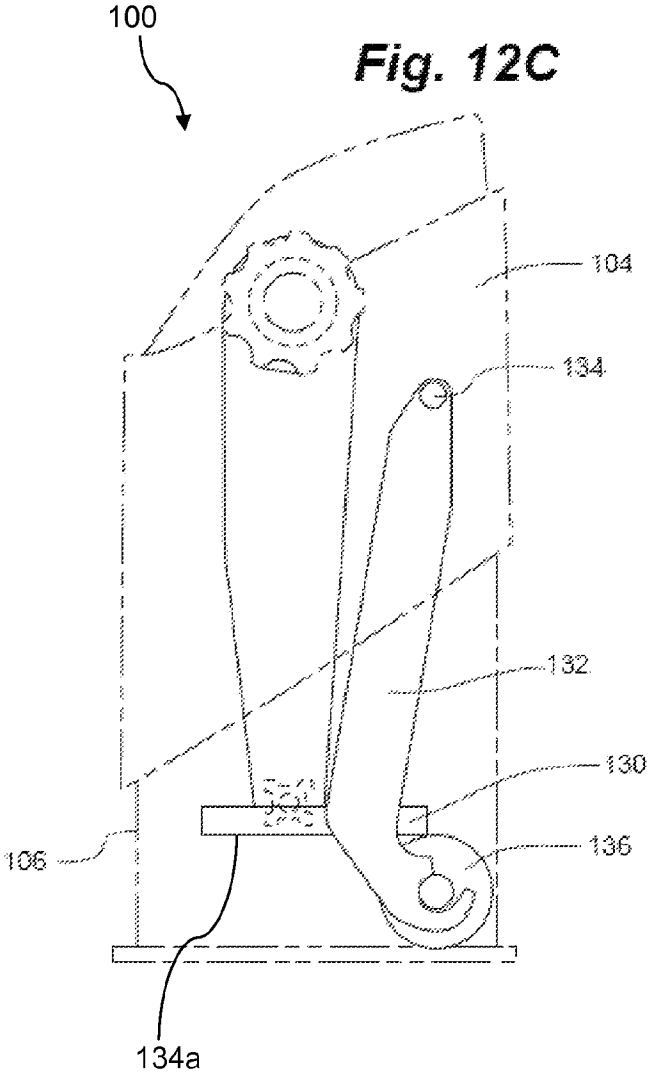
FIG. 12C is a side cross-sectional diagram of the self-inking marking device of FIG. 12A in an intermediate operational position.

Referring to FIG. 12C, the actuation process is continued. The user continues to apply force to the top of marking device 100, thus moving upper body 104 further toward lower body 106. Coil spring 148 or compression spring 150, in embodiments, is further compressed or forced, as appropriate, which further forces ink roller cartridge 136 in a direction across die plate 130. In FIG. 12C, ink roller cartridge 136 has moved nearly fully across die plate 130, and has completed inking the print side of print bands 120 that have been rotated into the print interface. Die plate 130 is further lowered.

Referring to FIG. 12D, the actuation process is continued. The user continues to apply force to the top of marking device 100, thus moving upper body 104 further toward lower body 106. In FIG. 12D, ink roller cartridge 136 has moved all the way across die plate 130, and is no longer in contact with die plate 130. Finally, the actuation process is completed when die plate 130 is fully lowered onto the receiving surface (not shown).

In another embodiment, a marking device is substantially similar to marking device 100, but comprises print bands 120 having print faces comprising alpha character indicia. In such an embodiment, print bands 120 can be adjusted by adjustment knob 128 similar to that as described above with respect to marking device 100. In embodiments, the alpha character marking device can comprise a wide length of print bands 120 and corresponding wide print interface 102 having individual displays similar to displays 112, 114, and 116, and accompanying sets of adjustment components 108: upper roller 122, lower roller 124, date band buffer 126, and adjustment knob 128, in an embodiment, such that print bands 120 can be adjusted to form words or phrases. In other embodiments, as described above, secondary sets of words or phrases can be formed on secondary sets of print bands 120 utilizing secondary sets of adjustment components 108 comprising one or more secondary print bands 120, secondary upper roller 122, secondary lower roller 124, secondary date band buffers 126, and secondary adjustment knob 128, with the corresponding print interface in an embodiment, as described above. In embodiments, entire sentences or phrases can therefore be spelled out.

In another embodiment, a marking device is substantially similar to marking device 100, but comprises print bands 120 having print faces comprising numeric indicia in a style of traditional numberers. In embodiments, print bands 120 of this numberer marking device are configured to have individual print face indicia that can represent identification numbers or numeric codes for product identification or packaging purposes. In embodiments, multiple or secondary print bands 120 are provided as discussed above in order to imprint multiple pieces of numberer data. In embodiments, a date or timestamp-style data can also be imprinted with the numberer data, by incorporating secondary sets of adjustment components 108 comprising one or more secondary print bands 120, secondary upper roller 122, secondary lower roller 124, secondary date band buffers 126, and secondary adjustment knob 128, with the corresponding print interface in an embodiment, as described above. In another embodiment, a marking device is substantially similar to marking device 100, but comprises a handle that extends upwards from a top surface of the marking device upper body 102 to form a so-called "heavy duty" marking device. The handle is configured to be operably coupleable with the hand of the user. Optionally, in embodiments, all or portions of upper body 102 or lower body 104 are open. For example, front and back walls are removed from marking devices having four sidewalls such that only the two remaining sidewalls provide the body of the heavy duty marking device. By removing the front and back wall material, cost savings can be recognized. In embodiments, the two remaining sidewalls can be reinforced with steel.

In another embodiment, a marking device is substantially similar to marking device 100, but printing components 110: die plate 130, swingarm 132, swingarm pivot 134, ink roller cartridge 136, first free space zone 138, and second free space zone 140 are absent or removed or, alternatively, are present but configured inactive to form a traditional non-self-inking marking device. In embodiments, the non-self-inking marking device allows a user to depress the print interface into an ink source, where ink is deposited onto the print interface, and subsequently allows the user to depress the inked print interface onto the receiving surface. Various embodiments of systems, devices and methods have been described herein. These embodiments are given only by way of example and are not intended to limit the scope of the invention. It should be appreciated, moreover, that the various features of the embodiments that have been described may be combined in various ways to produce numerous additional embodiments. Moreover, while various materials, dimensions, shapes, configurations and locations, etc. have been described for use with disclosed embodiments, others besides those disclosed may be utilized without exceeding the scope of the invention.

Figure 13:
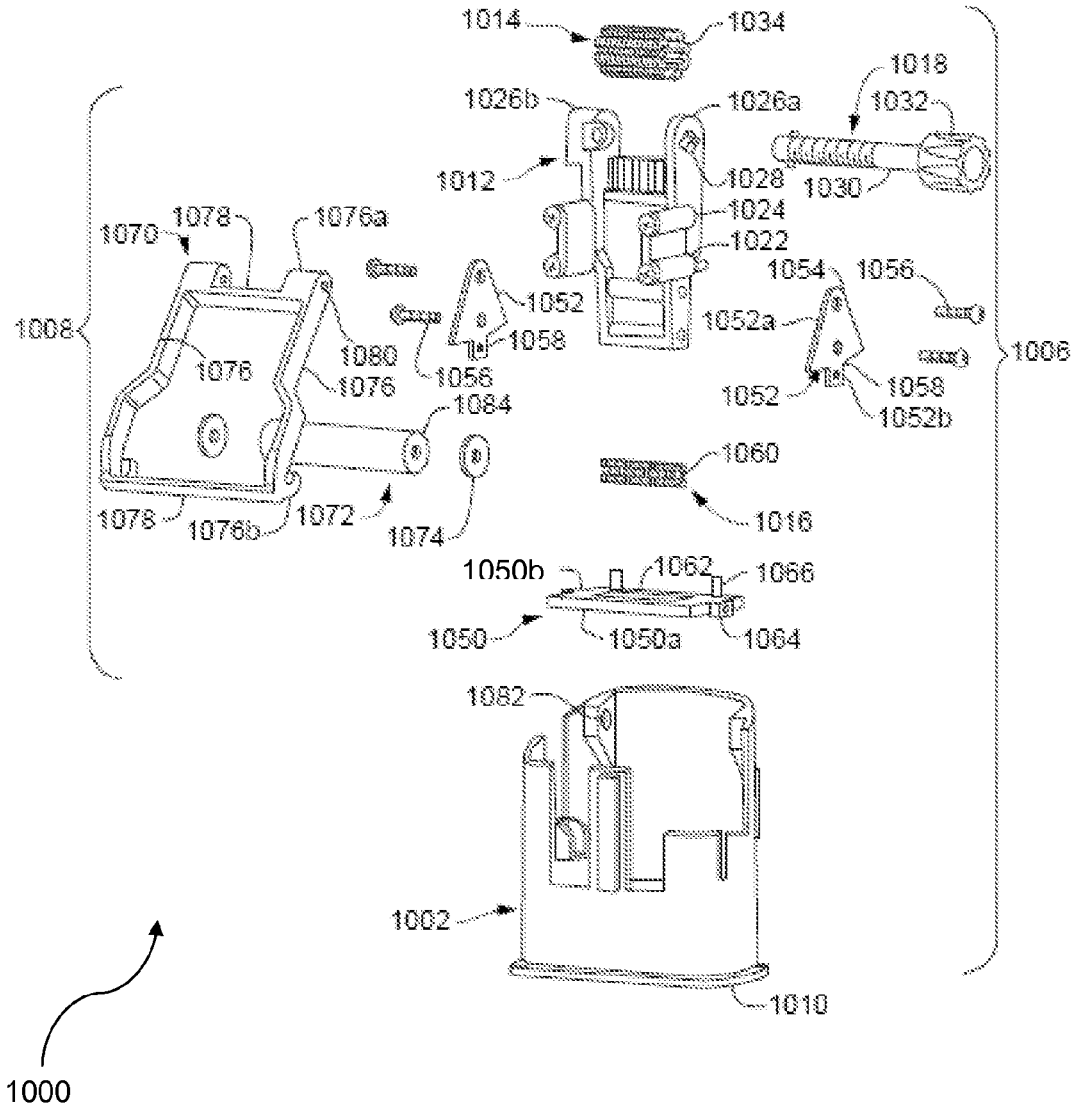
FIG. 13 is an exploded view of a portion of a self-inking marking device according to another embodiment of the invention.
Figure 14:
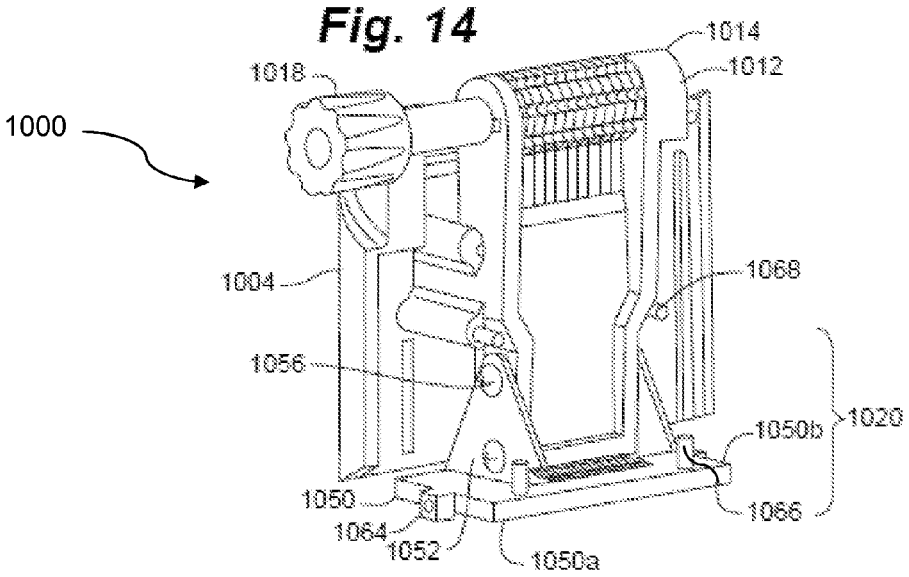
FIG. 14 is a cut-away front perspective view of a portion of a stamping assembly of the device of FIG. 13.

An alternative embodiment of the invention, illustrated in FIGS. 13, 14, and 15A-15D, provides a pivoting die plate to inhibit or prevent binding of the die plate which in turn prevents full motion of the self-marking or stamping device. Referring to FIGS. 13 and 14, device 1000 includes an outer or lower housing 1002, an upper housing 1004 (only a portion of which is shown in FIG. 13) shiftable relative to the lower housing 1002, a stamping assembly 1006 mounted to upper housing 1004, and an ink roller assembly 1008 pivotally mounted within lower housing 1002.

As discussed above with respect to body 106 of previous embodiments, lower housing 1002 includes structure for shiftably mounting upper housing 1004 thereto. Upper housing 1004 can be mounted to lower housing 1002 such that it shifts via tracks, cams, or other shifting mechanism from a neutral or resting position to a printing position in which marking or printing surfaces contact a substrate through an open end 1010 of lower housing 1002, and back to the neutral or resting position. Typically, a compression spring (not shown) operably couples lower housing 1002 to upper housing 1004. Upper housing 1004 can include the display screen as described above.

Stamping assembly 1006 includes a main support structure 1012, an upper idler 1014, a lower idler 1016, one or more one or more print bands (not shown), an adjustment mechanism 1018 for adjusting one or more print bands, and a die plate assembly 1020. Support structure 1012 includes threaded attachment sleeves 1022 for securing structure 1012 to upper housing 1004 by fasteners 1024, such as screws. Structure 1012 further includes a first shoulder 1026*a* spaced from a second shoulder 1026*b*, each shoulder 1026*a*, 1026*b* having an aperture 1028 therethrough for receiving upper idler 1014 between shoulders 1026*a*, 1026*b*. Adjustment mechanism 1018 comprises an arm 1030 and a knob 1032, arm 1030 extending through each shoulder aperture 1028 and a central bore 1034 of upper idler 1014, such that upper idler 1014 is rotatable with respect to structure 1012 upon rotation of adjustment mechanism 1018, as described with respect to adjustment knob 128 in previous embodiments.

Die plate assembly 1020 includes a die plate 1050, and one or more die block plates 1052 for pivotably coupling die plate 1050 to structure 1012. First and second die block plates 1052 each include a body portion 1052*a* having apertures 1054 for receiving fasteners 1056, such as screws, therethrough to fix die block plates 1052 to structure 1012. Each die block plate 1052 further includes a flange 1052*b* with an aperture 1058 for rotatably connecting lower idler 1016 to structure 1012 via a pivot pin (not shown) extending through apertures 1058 and a central bore 1060 of lower idler 1016.

Die plate 1050 comprises a flat plate having a first marking surface 1050*a* and a second, opposite non-marking surface 1050*b*, and a central opening 1062 extending between surfaces, as described above. Lower idler 1016 extends within and through central opening 1062 such that raised characters on a print band(s) (not shown) extend from a plane parallel to first marking surface 1050*a*. Each end of the pivot pin (not shown) extending through central bore 1060 of lower idler 1016, extends through a sleeved bore 1064 formed on each side of die plate 1050 to pivotably couple die plate 1050 relative to structure 1012, such that die block plates 1052 are sandwiched between an end of lower idler 1016 and an edge of central opening 162 of die plate 1050.

Optionally, first marking surface 1050*a* of die plate 1050 can comprise raised alphanumeric characters and/or graphics of standard or customized fixed data or indicia for stamping onto a substrate. This fixed data is in combination with the variable data provided by the adjustable print bands described infra.

Optionally, protrusions 1066 extending from second non-printing surface 1050*b* of die plate 1050 can be used to attach a first end of a compression spring (not shown), while a second end of compression spring is attached to a protrusion 1068 positioned on structure 1012, such as the end of fastener 1024. This compression spring ensures that die plate 1050 is at rest in a neutral, relatively horizontal position with respect to structure 1012. The compression spring, when stretched under force, ensures the return of die plate 1050 to the neutral position when the force is removed.

Ink roller assembly 1008 includes a swing arm 1070, ink roller 1072, and optional bearings 1074. Swing arm 1070, as described above, comprises parallel L- or J-shaped support arms 1076, connected at first and second ends by lateral ribs 1078. A first end 1076*a* of each arm 1076 includes structure defining an aperture 1080 for receiving a pivot pin therethrough (not shown) to pivotably couple swing arm 1070 to lower housing 1002 via apertures 1082 formed in lower housing 1002. A second end 1076*b* of each arm 1076 terminates in a hook shape for receiving and retaining an ink roller 1072 thereon, as described above with respect to previous embodiments. In one specific embodiment, a pin (not shown) extends through a central bore 1084 of ink roller 1072. Each end of the pin extends beyond the respective end of ink roller 1072, and is carried by the hook portion 1076*b* of the swing arm 1070. This allows for removable mounting of ink roller 1072 on swing arm 1070 for ease of change-out, and allows ink roller 1072 to freely rotate with respect to swing arm 1070.

In an optional embodiment, a bearing 1074 is placed on the pin on each side of ink roller 1072 such that bearing 1074 is sandwiched between ink roller 1072 and arm 1076 of swing arm 1070. Bearings 1074 are positioned such that during use during the inking process, an outer circumference of each bearing 1074 rolls along an outside edge of die plate 1050 so that ink roller 1072 maintains a fixed distance from, yet in contact with, die plate 1050 during inking. This in turn creates a fixed amount of compression for the soft, ink-filled ink roller 1072 to reduce or avoid the occurrence of over-application of ink to die plate 1050 and/or print bands that is otherwise observed when ink roller 1072 is compressed too deeply into die plate 1050 and/or print bands. Without a fixed amount of compression, in addition to over-application of ink, a large amount of friction can be created between ink roller 1072 and die plate 1050, thereby making it difficult to depress upper housing 1004 to complete the stamping process.

Referring to FIGS. 15A-15D, in use of this embodiment, incorporation of a pivot point P for die plate 1050 via pivotal mounting to structure 1012, allows an angle of die plate 1050 to change as ink roller 1072 passes across it during an inking cycle, thus creating clearance needed for device 1000 to complete its range of motion. Specifically, referring to FIG. 15A, device 1000 is at rest in an initial neutral position. Die plate 1050 is a substantially horizontal position, and swing arm 1070 with ink roller 1072 are proximate a first side 1002*a* of lower housing 1002.

Figure 15A:
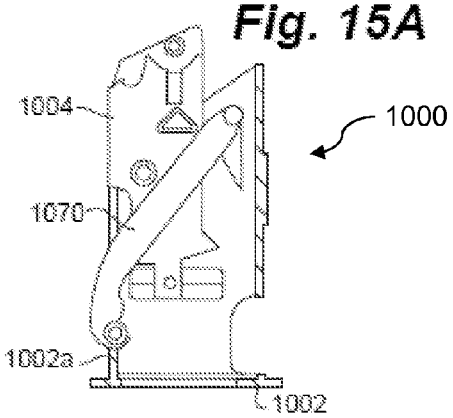
FIG. 15A is a side elevational view in cross-section of a self-inking marking device having a pivoting die plate in a neutral position, according to another embodiment of the invention.
Figure 15B:
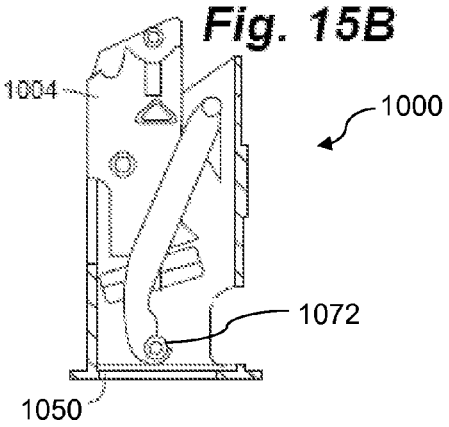
FIG. 15B is a side elevational view in cross-section of the self-inking marking device of FIG. 15A in an intermediate operational position in which the ink roller pivots the die plate.

Referring to FIG. 15B, as upper housing 1004 is initially compressed to start a stamping cycle, swing arm 1070 is biased forward into contact with die plate 1050, inking any raised characters on a first portion 1051 of die plate 1050 and print bands, until the force of roller assembly 1008 causes die plate 1050 to pivot at pivot point P, compressing the compression spring (not shown). The force direction on ink roller 1072 changes and push force is reduced.

Figure 15C:
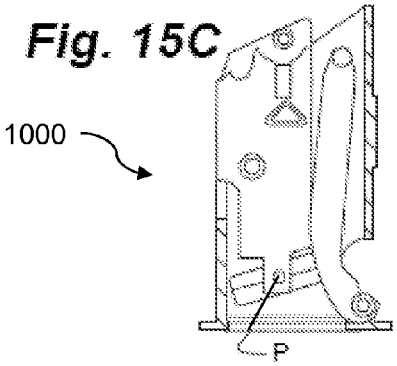
FIG. 15C is a side elevational view in cross-section of the self-inking marking device of FIG. 15A in an intermediate operational position in which the ink roller clears the die plate.

Referring to FIG. 15C, ink roller 1072 continues to move over a second portion 1053 of die plate 1050, inking any raised characters on second portion 1053 of die plate and print bands, until ink roller 1072 clears die plate 1050. Up until this point, the compression spring is spring loaded and is about to spring back to its neutral position which in turn returns die plate 1050 to its initial, substantially horizontal position.

Figure 15D:
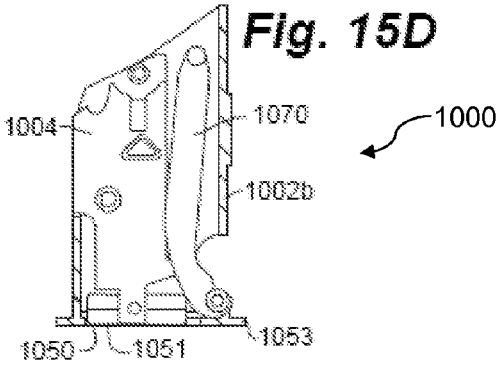
FIG. 15D is a side elevational view in cross-section of the self-inking marking device of FIG. 15A in an intermediate operational position in which the inked die plate contacts the substrate to be stamped.

Referring to FIG. 15D, upper housing 1004 is completely compressed such that inked die plate 1050 and print bands extend outside of aperture 1010 of lower housing 1002 to contact a substrate to be printed. Swing arm 1070 is positioned proximate a second side 1002*b* of lower housing 1002 and completely clear of die plate 1050. As the downward force on upper housing 1004 is removed (not shown), upper housing 1004 shifts back up to its initial resting position, while swing arm 1070 is rotated back to position proximate first side 1002*a* of lower housing 1002 such that device 1000 is restored to its initial position shown in FIG. 15A. A single stamp cycle is now complete.

A potential use of the device according to embodiments of the invention is to apply customized dies or fixed data to the die plate in the form of raised alphanumeric characters or graphics on the print side of the die plate. A non-limiting example of the customized die plate includes a business name and address. These customized die plates are produced by a variety of different stamp manufacturers using a variety of methods to create the die plates, such as, for example, wet or dry etching, laser engraving, to name a few. Consequently, a total thickness of the custom die plates can vary by as much as 1 mm or more. During printing, this variation can create a potential problem of the marking surface of the die plate not lying in the same plane as the marking surface of the print band(s). If the marking surface of the die plate extends lower than the marking surface of the print band(s), for example, when the stamp is actuated, it would leave an impression of the die plate only without the print bands.

In response to this, and referring to FIGS. 16-19, according to an alternative embodiment of the invention, stamping assembly 2000 comprises a support structure 2002, upper idler 2004 (similar to upper idler 1014), lower idler 2002 (similar to lower idler 1016), and a die plate assembly 2008 having an adjustment mechanism for adjusting a height of a die plate such that the marking surface of the die plate lies substantially within the same plane as the marking surface of the print band(s). Specifically, die plate assembly 2008 includes a die plate base 2010 that is coupled to support structure 2002, and a die plate 2012 fixedly and interchangeably coupled to die plate base 2010 via one or more adjustment cams 2014. Support structure 2002 is similar to support structure 1012 described in the previous embodiments of FIGS. 13, 14, and 15A-15D. A die block plate 2016 is fixed to each side of support structure 2002 as described in these previous embodiments. Alternatively, a die block plate 2016 is integrally formed on each side of support structure 2002. Each die block plate 2016 includes a flange 2018 having an aperture 2020 therethrough for receiving a pin for rotably securing lower idler 2006 to support structure 2002, and pivotably mounting die block assembly 2008 to support structure 2002. Flange 2018 further includes a ledge 2022 or shoulder extending therefrom for abutting engagement of die plate 2012.

Figure 16:
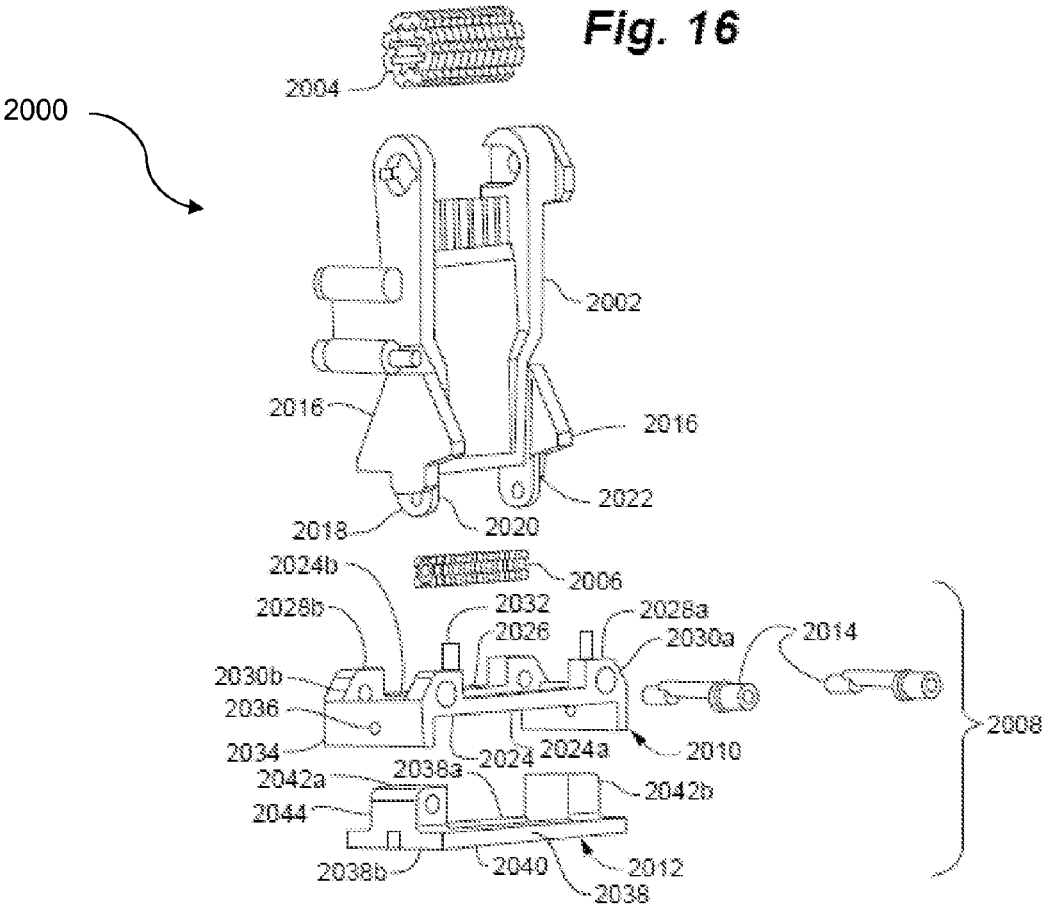
FIG. 16 is an exploded view of a stamping assembly of a self-marking device according to another embodiment of the invention.

Die plate base 2010 includes a plate portion 2024 having a central aperture 2026 therethrough for receiving a customized die plate 2012 within. A plurality of cam protrusions 2028*a*, 2028*b* extend from a first surface 2024*a* of plate portion 2024 of die plate base 2010, each protrusion 2028 including an aperture 2030 for receiving and frictionally retaining a cam 2014 therein. In one specific example, as shown in FIG. 16, die plate base 2010 includes four total protrusions, one at each corner, or two front protrusions 2028*a* and two rear protrusions 2028*b*.

First surface 2024*a* of plate portion 2024 of die plate base 2010 optionally includes one or more protrusions 2032 for securing an end of a compression spring (not shown) thereto for biased pivoting of die block assembly 2008 as described with respect to the embodiments of FIGS. 13, 14, and 15A-15D.

Die plate base 2010 further includes a side flange 2034 extending from a second surface 2024*b* of plate portion 2024 on each side edge of plate portion 2024. Each side flange 2034 includes an aperture 2036 that, when assembled with die block plate 2016 of support structure 2002, aligns with aperture 2020 of die block plate 2016 to receive a pin therethrough such that flange 2018 of die block plate 2016 is sandwiched between an end of lower idler 2006 and side flange 2034 of die plate base 2010.

Die plate 2012 comprises a plate portion 2038 having a non-marking surface 2038*a* and a marking surface 2038*b*, and a central aperture 2040 extending between, similar to the die plate 1050 described with respect to the embodiments of FIGS. 13, 14, and 15A-15D. Non-marking surface 2038*a* further includes a first protrusion 2042*a* extending along a central portion of a first edge of plate portion 2038, and a second protrusion 2042*b* extending along a central portion of a second, parallel edge of plate portion 2038. Each protrusion 2042 includes a central bore 2044 that, when assembled, align with apertures 2030 of cam protrusions 2028 of die plate base 2010, such that each protrusion 2042 is sandwiched between a front cam protrusion 2028*a* and a rear cam protrusion 2028*b* of die plate base 2010.

Figure 17:
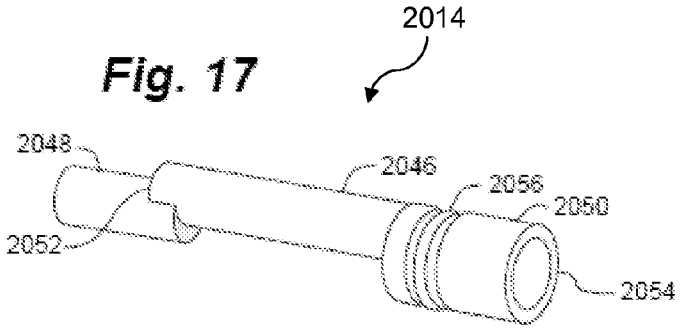
FIG. 17 is a perspective view of an adjustment cam of the stamping assembly of FIG. 16.

Referring to FIG. 17, adjustment cam 2014 includes a longitudinal pin, having a central portion 2046, a first offset portion 2048 extending from a first end of central portion 2046, and a second offset portion 2050 extending from a second end of central portion 2046. Central portion 2046 is generally oblong or eccentric in cross-section, i.e. scotch yoke mechanism, to allow for height adjustment of die plate 2012 relative to die plate base 2010. In one particular, non-limiting example, the cross section comprises a 1 mm eccentric 2052 translating to a maximum of 1 mm in height adjustment when cam 2014 is rotated 180 degrees.

Referring to FIG. 16, first offset portion 2048 is substantially circular in cross-section and is received and frictionally retained within corresponding aperture 2030*b* of rear cam flanges 2028*b* of die plate base 2010, having corresponding cross-sections. Second offset portion 2050 can comprise an adjustment opening or structure 2054, such as Alan key socket or screw head (Philips type or flat-head), for rotation of adjustment cam 2014 within front cam apertures 2030*a*. Each cam aperture 2030*a* of die plate base 2010 is of a sufficient cross section to allow passage of first offset portion 2048 and central portion 2046 of cam 2014 therethrough, while receiving and frictionally retaining second offset portion 2050 within.

Figure 18:
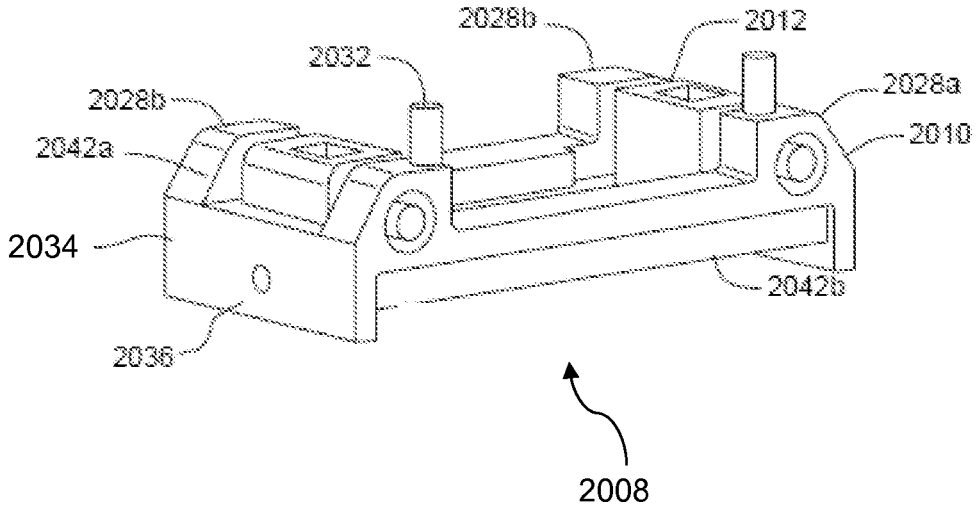
FIG. 18 is a perspective view of a die plate assembly of the stamping assembly of FIG. 16.
Figure 19:
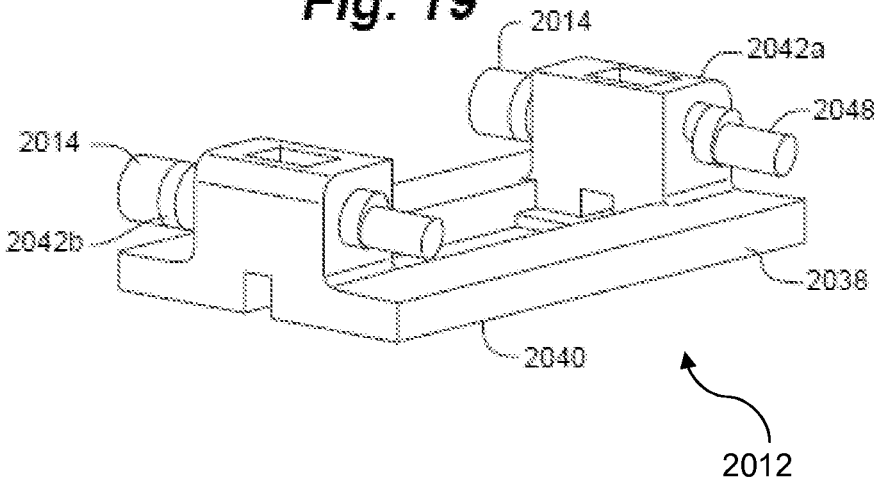
FIG. 19 is a perspective view of a die plate and adjustment cams of the stamping assembly of FIG. 16.

In use, when assembled, and referring to FIGS. 18 and 19, when die plate assembly 2008 is an a first or "0" position, eccentric 2052 of body portion 2046 of adjustment cam 2014 is facing upward toward support structure 2002, die plate 2012 is in its "up" position. As adjustment cam 2014 is rotated, for example, by a corresponding adjustment tool such as an Alan key or screwdriver (flat or Phillips-type), the height or position of die plate 2012 relative to die plate base 2010 moves downward. At 180 degree rotation from the first or "0" position, die plate 2012 is at its bottom-most position as eccentric 2052 of adjustment cam 2014 is facing downward toward the print surface or substrate such that the marking surface height (or die height) is maximized relative to the marking surface of the print band(s).

The friction fit of cam 2014 in corresponding aperture 2030*a* maintains cam 2014 in its desired position. Optionally, retaining ring grooves 2056 can be formed in the surface of second offset portion 2050 to retain O-rings therein, thereby enhancing the friction fit by creating high friction to resist losing the desired adjustment setting.

By utilizing this adjustment mechanism, an optimal die plate position can be located for a given die height. Optionally, once optimal die position is achieved for a particular die plate, a permanent adhesive, such as superglue, rubber cement, epoxy, or the like, can be applied to the interface between cam and die plate base to lock it in its desired position.

Persons of ordinary skill in the relevant arts will recognize that the invention may comprise fewer features than illustrated in any individual embodiment described above. The embodiments described herein are not meant to be an exhaustive presentation of the ways in which the various features of the invention may be combined. Accordingly, the embodiments are not mutually exclusive combinations of features; rather, the invention may comprise a combination of different individual features selected from different individual embodiments, as understood by persons of ordinary skill in the art.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

What is claimed is:

1. A marking device having one or more adjustable print bands, each print band comprising a plurality of print faces, the adjustable print bands being adjustable to present a selected print face for printing on a receiving surface, the marking device comprising:

a body comprising an upper section and a lower section, the upper section being shiftable with respect to the lower section between a neutral position and a printing position;

a support structure the having one or more adjustable print bands coupled thereto, a top end of the support structure being coupled to an interior of the upper section of the body;

a die plate configured to operably couple a stamping die to the support structure proximate the selected print faces, the die plate being pivotably coupled to a bottom end of the support structure;

a swingarm assembly including at least one cantilevering member operably coupled to the upper section at a pivot, and a biasing member operably coupled to the body and the at least one cantilevering member, and configured to actuate the at least one cantilevering member about the pivot;

an ink roller operably coupled to the at least one cantilevering member opposite the pivot;

wherein upon shifting of the body from the neutral position to the printing position, the support structure is configured to travel along the lower section of the body to position the selected print faces of each of the one or more print bands proximate an opening of the lower section and the receiving surface, while the ink roller is configured to move into contact with and across the selected print faces of each of the one or more print bands by movement of the at least one cantilevering member through the biasing of the biasing member against the body, thereby inking the selected print faces, and the die plate is configured to pivot upon ink roller contact with and across the selected print faces, and wherein the cantilevering member is configured to move the ink roller away from the inked selected print faces and at least partially outside the body when the body is in the printing position to allow the selected print faces of each of the one or more print bands to contact the receiving surface.

2. The marking device of claim 1, further comprising at least one adjustment cam operably coupled to the support structure and configured to adjust a height of the die plate relative to the body.

3. The marking device of claim 1, wherein the ink roller further comprises a registration to return the ink roller to a known position upon shifting of the body to the neutral position.

4. The marking device of claim 1, wherein the body includes a display interface, wherein each print band has a print side comprising the plurality of print faces, and a read side comprising a plurality of display faces, wherein each print face of the print side corresponds to a display face of the read side, the marking device further comprising:

an adjustment mechanism positioned on an exterior surface of the body, the adjustment mechanism being selectively shiftable with respect to the body between a first plurality of positions, wherein, upon shifting of the adjustment mechanism between positions of the first plurality of positions, each print face of the one or more print bands is shiftable proximate the opening of the lower section, and a corresponding display face is displayed in the display interface indicating the selected print face, and wherein upon shifting of the body between the neutral position and the printing position, the selected print face of each of the one or more print bands extends at least partially through the opening of the lower section to contact the surface to be printed.

5. The one or more adjustable print bands of claim 1, wherein the marking device comprises a plurality of print bands, wherein the adjustment mechanism is further selectively shiftable with respect to the body between a second plurality of positions, and wherein the adjustment mechanism is engaged with a different print band of the plurality of print bands at each position of the second plurality of positions.

6. The marking device of claim 5, further comprising a plurality of print band buffers, each of the print band buffers positioned proximate two of the plurality of print bands and configured to maintain print band alignment.

7. The marking device of claim 6, wherein the print band buffer is further configured to increase a travel length of a print band.

8. The marking device of claim 5, wherein the adjustment mechanism comprises an adjustment knob.

9. The marking device of claim 8, wherein the adjustment knob is configured to move transverse to the body, thereby shifting the adjustment mechanism between the positions of the first plurality of positions to engage a print band of the plurality of print bands corresponding to the position.

10. The marking device of claim 9, wherein the adjustment knob is further configured to rotate relative to the body, thereby shifting the adjustment mechanism between the positions of the second plurality of positions in order to select a print face from the engaged print band.

11. The marking device of claim 8, further comprising a plurality of haptic detents, each detent positioned between two of the plurality of print bands and adapted to mechanically arrest the transverse movement of the adjustment knob.

12. The marking device of claim 11, wherein the plurality of haptic detents are varied to provide differing impedance to the adjustment knob between print bands.

13. The marking device of claim 1, further comprising:

at least one die plate display card positionable proximate the display interface; and a display card storage configured to store the at least one die plate display card.

14. The marking device of claim 1, wherein the display interface is positioned on either a top of the upper section or a side of the lower section.

15. The marking device of claim 1, wherein each of the print bands further comprises a hard stop between the print side and the read side to inhibit movement of the display faces into the opening of the lower section and the print faces into the display interface.

16. The marking device of claim 1, wherein the display interface comprises a background color and the display faces comprise a contrasting color to the background color.

* * * * *